US012330267B2

(12) United States Patent
Bankaitis et al.

(10) Patent No.: US 12,330,267 B2
(45) Date of Patent: Jun. 17, 2025

(54) METHOD AND APPARATUS FOR EDGE FINISHING OF HIGH MECHANICAL STRENGTH THIN GLASS SUBSTRATES

(71) Applicant: CORNING INCORPORATED, Corning, NY (US)

(72) Inventors: Jonas Bankaitis, Horseheads, NY (US); Duc Anh Bui, Krailling (DE); Scott Steven Cronk, Webster, NY (US); Christopher Paul Daigler, Cedar Park, TX (US); Christina Marie Laskowski, Painted Post, NY (US); Neil Eugene Partridge, Avoca, NY (US); Uwe Stute, Neustadt am Rubenberge (DE); Sergio Tsuda, Horseheads, NY (US); Chad Michael Wilcox, Warrenton, VA (US)

(73) Assignee: CORNING INCORPORATED, Corning, NY (US)

( * ) Notice: Subject to any disclaimer, the term of this patent is extended or adjusted under 35 U.S.C. 154(b) by 513 days.

(21) Appl. No.: 17/621,049

(22) PCT Filed: Jun. 11, 2020

(86) PCT No.: PCT/US2020/037120
§ 371 (c)(1),
(2) Date: Dec. 20, 2021

(87) PCT Pub. No.: WO2020/257034
PCT Pub. Date: Dec. 24, 2020

(65) Prior Publication Data

US 2022/0339751 A1 Oct. 27, 2022

Related U.S. Application Data

(60) Provisional application No. 62/864,131, filed on Jun. 20, 2019, provisional application No. 62/872,410, filed on Jul. 10, 2019.

(51) Int. Cl.
*B32B 15/04* (2006.01)
*B24B 9/10* (2006.01)
(Continued)

(52) U.S. Cl.
CPC ..... *B24B 9/10* (2013.01); *B24B 29/005* (2013.01)

(58) Field of Classification Search
CPC ..... B24B 29/005
(Continued)

(56) References Cited

U.S. PATENT DOCUMENTS 6,354,911 B1 3/2002 Lindquist et al.
7,837,536 B2 11/2010 Haneda et al.
(Continued)

FOREIGN PATENT DOCUMENTS

CN 103586752 A 2/2014
CN 106029595 A 10/2016
(Continued)

OTHER PUBLICATIONS

WO2014013996 English machine translation (Year: 2014).*
(Continued)

*Primary Examiner* — Lauren R Colgan
(74) *Attorney, Agent, or Firm* — William M. Johnson; Payal A. Patel

(57) ABSTRACT

Processes and devices by which a brittle material substrate may be edge formed and finished to simultaneously remove corresponding damage remaining on the edges in the areas formed by cutting and separation while imposing a desired edge profile and achieving a desired mechanical edge strength. Processes of the present disclosure may include a chemical and mechanical brush polishing process configured to shape and/or polish a surface of one or more thin substrates. A plurality of substrates may be arranged in a
(Continued)

stacked configuration, and engineered interposer devices may be arranged between the stacked substrates. The interposers may provide between the substrates and may direct filament placement during brushing so as to guide material removal on the substrate edges. Substrate edge profile shapes, including symmetric and asymmetric profiles, may be formed by strategic manipulation of interposer properties including dimensions, mechanical features, material properties, and positioning.

11 Claims, 20 Drawing Sheets

(51) Int. Cl.
*B24B 29/00* (2006.01)
*B32B 17/06* (2006.01)

(58) Field of Classification Search
USPC ..... 428/410, 426
See application file for complete search history.

(56) References Cited

U.S. PATENT DOCUMENTS

| | | | | |
|---|---|---|---|---|
| 7,959,492 | B2 | 6/2011 | Haneda et al. | |
| 8,186,000 | B2 | 5/2012 | Hettes | |
| 8,974,268 | B2 * | 3/2015 | Darcangelo | B24B 9/065 451/36 |
| 9,597,766 | B2 | 3/2017 | Hayashi et al. | |
| 10,173,916 | B2 | 1/2019 | Bankaitis et al. | |
| 10,280,110 | B2 * | 5/2019 | Zhang | C09K 13/08 |
| 10,343,249 | B2 * | 7/2019 | Jotz | B24B 9/10 |
| 10,384,324 | B2 * | 8/2019 | Shafrir | B32B 37/12 |
| 10,974,990 | B2 * | 4/2021 | Da | C03C 21/002 |
| 11,389,919 | B2 * | 7/2022 | Shafrir | B24B 29/005 |
| 2007/0271718 | A1 | 11/2007 | Hettes | |
| 2008/0005860 | A1 | 1/2008 | Niizaki et al. | |
| 2008/0200097 | A1 | 8/2008 | Haneda et al. | |
| 2009/0100621 | A1 | 4/2009 | Niizaki et al. | |
| 2009/0100622 | A1 | 4/2009 | Niizaki et al. | |
| 2009/0193601 | A1 | 8/2009 | Tan et al. | |
| 2010/0279067 | A1 * | 11/2010 | Sabia | C03B 17/064 428/141 |
| 2011/0123834 | A1 | 5/2011 | Hoshino et al. | |
| 2011/0318994 | A1 * | 12/2011 | Darcangelo | B24B 1/005 252/79.1 |
| 2012/0040146 | A1 * | 2/2012 | Garner | C03C 17/28 65/53 |
| 2012/0052302 | A1 * | 3/2012 | Matusick | C03C 17/32 216/97 |
| 2013/0086764 | A1 | 4/2013 | Vetter | |
| 2013/0205529 | A1 | 8/2013 | Flesch | |
| 2013/0273810 | A1 | 10/2013 | Hsu et al. | |
| 2013/0288010 | A1 * | 10/2013 | Akarapu | B24B 9/10 428/192 |
| 2014/0065401 | A1 * | 3/2014 | Donovan | C03C 3/093 428/220 |
| 2014/0170388 | A1 | 6/2014 | Kashima et al. | |
| 2015/0060401 | A1 * | 3/2015 | Chang | C03C 19/00 216/38 |
| 2015/0225285 | A1 | 8/2015 | Domey et al. | |
| 2015/0367477 | A1 | 12/2015 | Hayashi et al. | |
| 2017/0042320 | A1 | 2/2017 | Potocka | |
| 2017/0172288 | A1 | 6/2017 | Bart et al. | |
| 2017/0232571 | A1 * | 8/2017 | Bankaitis | B24B 9/102 451/184 |
| 2017/0265636 | A1 | 9/2017 | Hanneken et al. | |
| 2018/0001434 | A1 * | 1/2018 | Shafrir | C03B 17/02 |
| 2018/0057399 | A1 | 3/2018 | Harada et al. | |
| 2018/0073967 | A1 * | 3/2018 | Agnello | G01N 3/20 |
| 2019/0381786 | A1 * | 12/2019 | Watanabe | B41M 5/0088 |

FOREIGN PATENT DOCUMENTS

| | | | |
|---|---|---|---|
| CN | 108296901 | A | 7/2018 |
| EP | 3290153 | A1 | 3/2018 |
| JP | 2009-048688 | A | 3/2009 |
| JP | 2010-269389 | A | 12/2010 |
| JP | 5363190 | B2 | 12/2013 |
| TW | 201335814 | A | 9/2013 |
| TW | 201412654 | A | 4/2014 |
| WO | 2013/099656 | A1 | 7/2013 |
| WO | 2013/099847 | A1 | 7/2013 |
| WO | 2014/013996 | A1 | 1/2014 |

OTHER PUBLICATIONS

European Patent Application No. 20751698.0 Communication pursuant to Article 94(3) EPC dated Apr. 26, 2024; 8 Pages; European Patent Office.

International Search Report and Written Opinion of the International Searching Authority; PCT/US2020/037120; dated Sep. 10, 2020; 11 pages; European Patent Office.

Taiwanese Patent Application No. 109120804, Office Action dated Mar. 5, 2023, 5 pages (English Translation only), Taiwanese Patent Office.

* cited by examiner

| Step | Grit | Feed Rate (mm/min) | Spindle Speed (rpm) | DOC (μm) | Passes | Cycle Time (min) | Mat'l Rem (μm) | Edge R'ness (Ra) | Edge Strength (MPa) |
|---|---|---|---|---|---|---|---|---|---|
| 1 | 400 | 762 | 4500 | 58 | 4 | 2:37 | 234 | 333 | 149 |
| 2 | 800 | 762 | 4500 | 38 | 3 | 1:57 | 114 | 295 | 168 |
| 3 | 3000 | 279 | 4500 | 4 | 5 | 8:56 | 20 | 176 | 228 |
| 4 | V2 | 381 | 4500 | 3.8 | 4 | 5:13 | 15 | 31 | 278 |
| Total | | | | | 16 | 18:43 | 383 | 31 | 278 |

Edge forming/finishing of laminated glass

General Brushed Region Appearance

METHOD AND APPARATUS FOR EDGE FINISHING OF HIGH MECHANICAL STRENGTH THIN GLASS SUBSTRATES

CROSS-REFERENCE TO RELATED APPLICATIONS

This application claims the benefit of priority under 35 U.S.C. § 371 of International Application No. PCT/US2020/037120, filed on Jun. 11, 2020, which claims the benefit of priority under 35 U.S.C. § 119 of U.S. Provisional Application Ser. No. 62/872,410 filed on Jul. 10, 2019 and U.S. Provisional Application Ser. No. 62/864,131filed on Jun. 20, 2019, the content of which are relied upon and incorporated herein by reference in their entirety.

BACKGROUND

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

Demand is strong and increasing for high edge strength thin glass display substrates of complex form factors. Where demand for such substrates conventionally resided in the consumer electronics space (e.g., handheld electronics), it is now growing rapidly in new spaces such as automotive and even advanced optics applications. Much like their handheld electronics counterparts (cell phones and tablets), new thin glass substrates of complex shapes are often made from thin glass to satisfy consumer requirements for overall weight (as in the case of automotive glazing products), surface cleanliness (as in the case of electrochromic windows in the architectural glass space), and functionality (as in the case of automotive interior products) while maintaining high mechanical edge strength.

Conventional singulation of thin substrates, such as glass substrates, having relatively high strength often includes a plurality of mechanical edge grinding and polishing steps. Typically, edges may be formed using course grinding materials, which may introduce subsurface damage on substrate edges. The edges may further be subject to a progression of grinding steps with a plurality of grinding wheels having decreasing abrasive sizes in order to reduce the subsurface damage introduced by the initial edge forming. The edge grinding steps may be used to reduce subsurface damage introduced by initial grinding or other edge forming processes. FIG. 1 shows a series of mechanical grinding steps performed according to some conventional edge forming processes. As shown, each grinding step may require a plurality of passes using a different grit. Such mechanical grinding may damage the edges of the substrate, leaving cuts, chips, and other flaws that lower mechanical edge strength of the substrate. To remove damage caused by the mechanical grinding and thus improve edge strength, the edges are typically polished with a progression of polishing wheels.

Such conventional edge forming and finishing processes may be time consuming, capital inefficient, and expensive, often comprising one of the most expensive and time-consuming operations of the substrate formation, particularly where edges of interior features of a substrate are formed and finished as well. In some cases, edge forming and finishing may comprise up to 50% of the total substrate manufacturing cost. As may be appreciated from FIG. 1, the number of passes for the various grinding steps employed may prove to be a relatively time-consuming process. Additionally, grind wheels, polishing wheels, grinding coolant, dressing materials, cutting wheels, cutting fluids, and other grinding consumables may be relatively expensive and may require implementation of strict process controls such as wear rate monitoring. Substrate utilization may be relatively low with such forming and finishing processes when manufacturing complex and/or irregular shapes. Dimensional control may be relatively challenging as tight material removal control may be difficult to achieve. Downstream processes such as screen printing or other decoration may require relatively tight finished substrate dimensional tolerances (e.g., ±50 μm) to enable precise decoration and to prevent liquid inks from contacting smooth, polished edges. Such tolerances may be relatively difficult to meet with conventional mechanical grinding and polishing. Process throughput may be thermally limited, and mechanical grinding speed may be limited by an ability to cool the grind zone. Moreover, inverse geometry edge profiles produced using conventional grinding wheels may decay under grinding operations.

Substrate edge strength achieved by conventional mechanical grinding and polishing may be relatively low, falling short of 300 MPa in some cases, as may be appreciated with respect to FIG. 1. Moreover, aesthetic requirements in some markets (such as automotive interior, for example) may demand a relatively low number of edge chips and a relatively small chip size tolerance, which may necessitate a high number of grinding steps or passes to achieve acceptable yield. Increased grinding steps and passes may increase cost and throughput.

Thus, there is a need in the art for an improved edge forming and finishing process suitable for manufacturing high strength, complex form, thin substrates.

SUMMARY

The following presents a simplified summary of one or more embodiments of the present disclosure in order to provide a basic understanding of such embodiments. This summary is not an extensive overview of all contemplated embodiments and is intended to neither identify key or critical elements of all embodiments, nor delineate the scope of any or all embodiments.

The present disclosure relates to high strength thin substrates of complex form factor. In particular, the present disclosure relates to singulation of high strength thin substrates, such as high strength glass substrates, including near net shaping, edge profiling and finishing. More particularly, the present disclosure relates to methods and devices for forming and finishing edges of high strength thin glass substrates.

The present disclosure, in one or more embodiments, relates to a substrate with a polished edge, the substrate having a mechanical edge strength of at least 700 MPa and edge flaws of not more than 2 microns in size. The substrate may comprise a brittle material (as described herein). The polished edge may have a plurality of brush marks arranged thereon in a substantially parallel configuration. The substrate may have a thickness of between approximately 0.01 mm and approximately 6 mm. In some embodiments, the substrate may have a mechanical edge strength of at least 1 GPa. The substrate may have a chamfered or radiused edge profile in some embodiments. Moreover, the substrate may be a glass laminate in some embodiments.

The present disclosure, in one or more embodiments, additionally relates to a method of simultaneously forming and finishing an edge surface of a substrate. The method may include arranging a near-net shaped substrate between a first interposer and a second interposer, applying a compressive force to the substrate and interposers, and simultaneously shaping and polishing an edge surface of the substrate using a brush, wherein each interposer device includes a size and edge profile configured to guide the brush to achieve a desired edge profile shape of the substrate. In some embodiments, shaping and polishing the edge surface of the substrate may include brushing the edge surface with a rotary brush and a polishing slurry. The polishing slurry may include a cerium oxide with a grain size ranging from 0.3 to 15.0 μm. The polishing slurry may include a mechanical abrasive slurry with an abrasive size ranging from 30 nm to 100 μm. Moreover, the polishing slurry may have an alkalinity ranging from pH 6-10. In some embodiments, the brush may have a plurality of filaments, each having a diameter of not more than 0.2 mm. Each interposer device may include a contoured edge and a thickness of between 0.01 and 10 times a thickness of the substrate. In some embodiments, simultaneously shaping and polishing an edge surface of the substrate may include chamfering and polishing an edge surface of the substrate. A liquid impermeable seal may be formed between each interposer device and the substrate. In some embodiments, the substrate may include strengthened glass, unstrengthened glass, ceramic, or silicon. Additionally, in some embodiments, the first interposer may have a first size and the second interposer may have a second size smaller than the first size.

The present disclosure, in one or more embodiments, additionally relates to an interposer for separating adjacent near-net shaped substrates during a brushing operation performed on an edge surface of the substrates. The interposer may include a perimeter shape configured to align with a perimeter shape of the substrates, a thickness of between 0.01 and 10 times a thickness of the substrates, an edge profile corresponding to a desired edge profile shape of the substrates, and a width corresponding to the desired edge profile shape of the substrates. In some embodiments, the interposer may include a gromet arranged through an opening in the interposer, the gromet configured to increase friction between the interposer and adjacent substrates. Additionally, the interposer may have an opening configured to align with an opening of the substrates for brushing of an interior edge of the substrates.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DESCRIPTION

The present disclosure relates to processes and devices by which a brittle material substrate, which may be near-net shaped by a range of cutting and separation technologies, may be edge formed and finished to simultaneously remove corresponding damage remaining on the edges in the areas formed by cutting and separation while imposing a desired edge profile and achieving a desired mechanical edge strength. Processes and devices of the present disclosure may be employed to achieve a substrate edge with flaws of no more than 1.0 micrometers and a mechanical edge strength of up to or exceeding 1.25 GPa. Additionally, processes and devices of the present disclosure may be employed to achieve a substrate edge with an average roughness (Ra) of no more than 10 nm, root mean square roughness (Rms) of no more than 20 nm, and a peak to valley (PV) or no more than 500 nm. The brittle material substrates may be of primitive form (unstrengthened glasses, strengthened glasses, ceramics, silicon, metals, or other) or processed with coatings, decorations, and/or thin film devices.

Some particular substrate materials that may be formed and finished using processes and devices of the present disclosure may include soda-lime glass, annealed soda-lime glass, aluminosilicate glass, alkali aluminosilicate glass, laminated glass (or glass laminates) having any suitable core and clad materials, and/or other brittle materials. Processes and devices described herein may be employed to form and/or finish a substrate having any suitable edge profile shape, which may be a symmetric shape or asymmetric shape.

Processes of the present disclosure may include a chemical and mechanical brush polishing process configured to shape and/or polish a surface of one or more thin substrates. In some embodiments, a plurality of substrates may be formed and finished together in a batch brushing process. The plurality of substrates may be arranged in a stacked configuration, and engineered interposer devices may be arranged between the stacked substrates. The interposers may provide space between the substrates and may additionally be configured to direct filament placement during brushing so as to guide material removal on the substrate edges. In this way, the interposers may be shaped and sized so as to expose desired portions of the substrate edges and side surfaces to brushing while protecting other portions from brushing. Substrate edge profile shapes, including symmetric and asymmetric profiles, may be formed by strategic manipulation of interposer properties including dimensions, mechanical features, material properties, and positioning within the processing batch.

Figure 1:
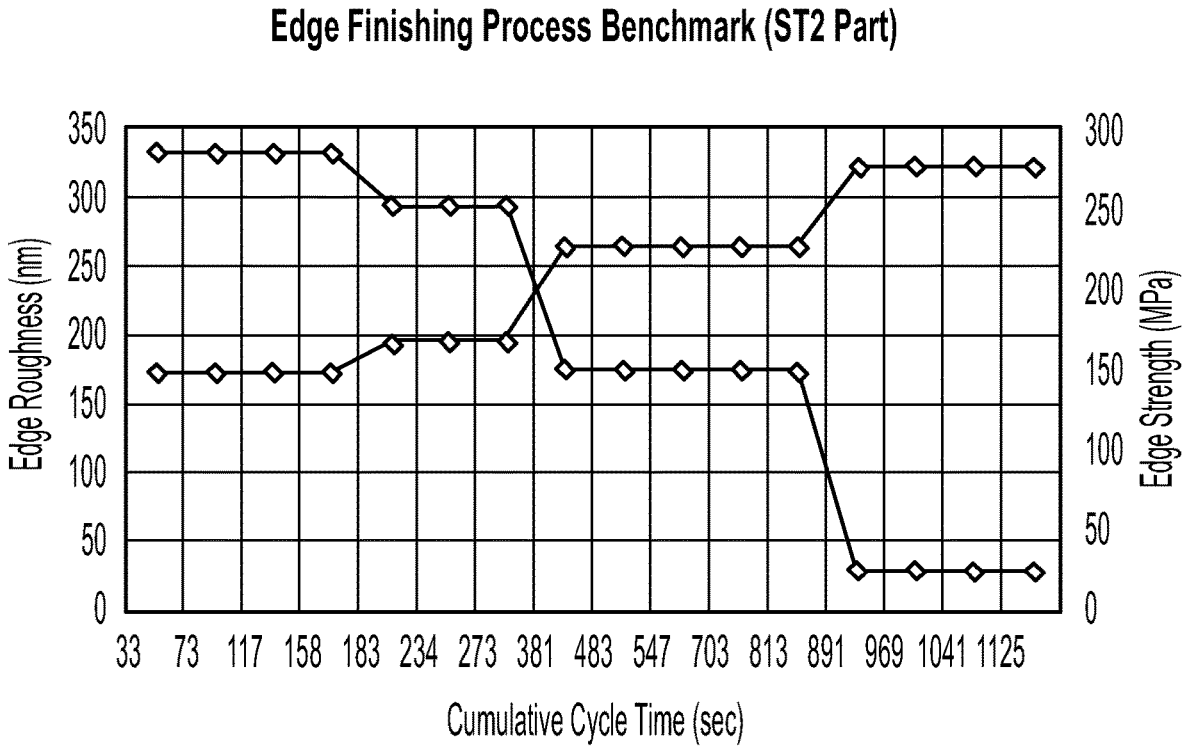
FIG. 1 provides a chart of mechanical edge grinding steps according to a conventional edge grinding process.
Figure 2:
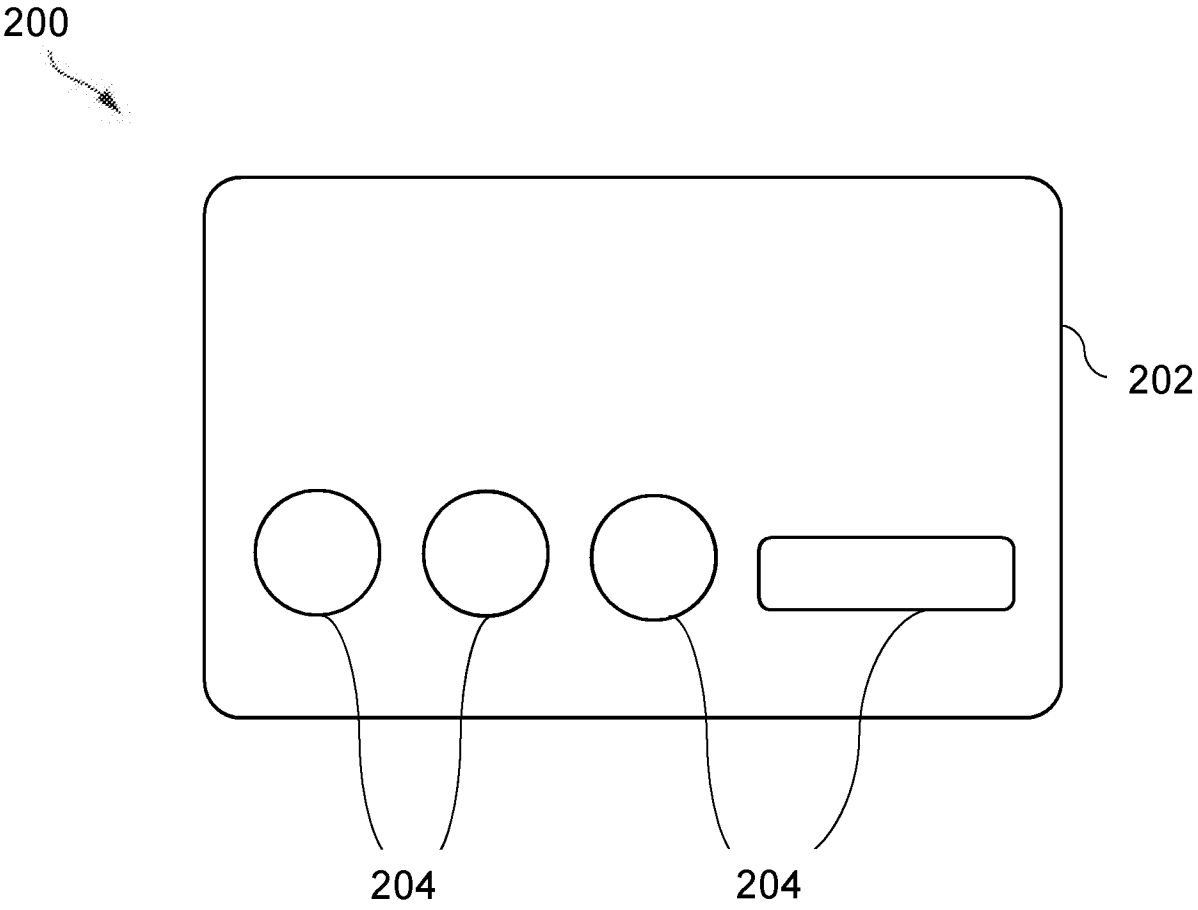
FIG. 2 is a front view of a complex feature automotive interior display substrate that may be subject to edge forming and finishing.

Brittle substrates having a thickness of between approximately 0.005 mm and approximately 12.0 mm, or between approximately 0.01 mm and approximately 6.0 mm, or having any other relatively small thickness, may be used in a variety of industries and for a variety of technologies and applications, including for example screens or surfaces for handheld electronics such as cell phones and tablet computers and automotive interior surfaces, such as dashboard components. Such substrates may have, for example, a length, width, or diameter of between approximately 50 mm and approximately 1500 mm, or may have any other suitable dimensions. Materials for such applications may include glass, glass laminates, silicon, and/or other suitable materials. These thin components may have particular consumer or manufacturer requirements for overall weight, surface cleanliness, functionality, and edge strength. Such components may additionally have relatively complex shapes and/or may have interior features in some cases. FIG. 2 shows one embodiment of a complex feature automotive interior display substrate 200 that may require edge forming and finishing to achieve a desired edge strength. As may be appreciated with respect to FIG. 2, some complex shapes may have one or more exterior edges 202 and one or more interior edges 204. The interior and/or exterior edges may be subject to forming and finishing processes to achieve a desired edge profile shape, mechanical edge strength, and/or edge roughness.

Figure 3:
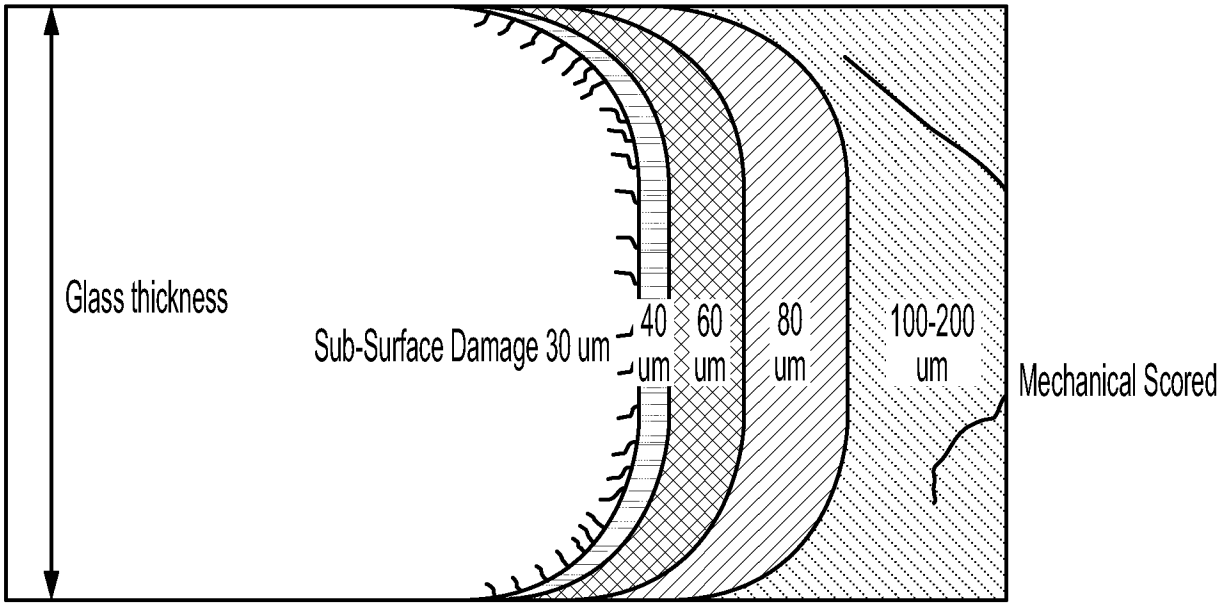
FIG. 3 is a conceptual internal drawing of subsurface damage on a substrate edge that may occur with conventional edge forming and finishing processes.
Figure 4:
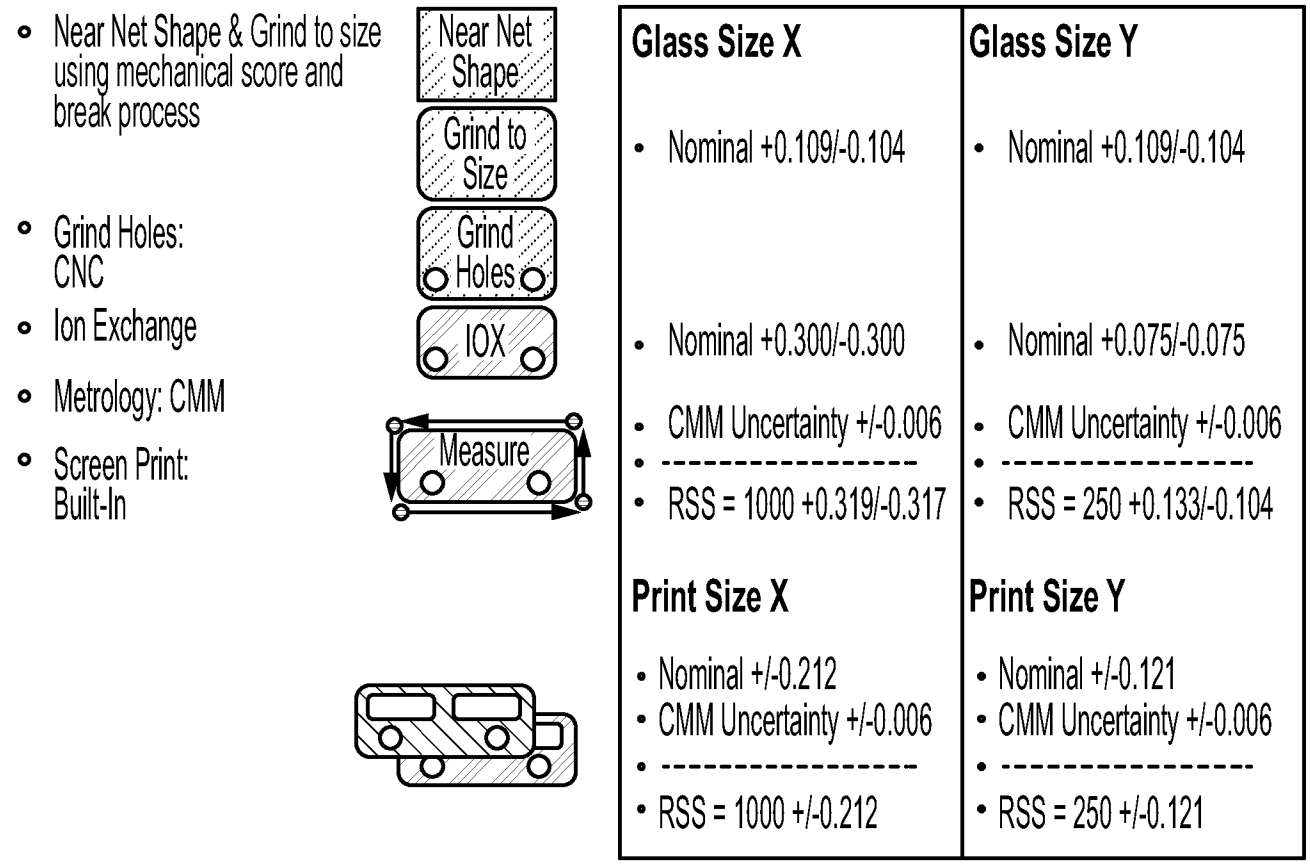
FIG. 4 shows an error budget analysis conducted on an example thin substrate according to a conventional edge forming and finishing process.

Conventional forming and finishing processes may introduce cracks, chips, and/or other flaws into a substrate. FIG. 3 illustrates an example of sub-surface damage that conventional forming and finishing processes can leave. Mechanical scoring and breaking can leave deep cracks in the substrate, while mechanical grinding processes can create additional sub-surface damage that may be difficult to remove by polishing. Conventional forming and finishing processes can also pose dimensional control challenges. FIG. 4 provides an error budget analysis conducted on an example automotive interior thin glass substrate manufacturing process. The error budget analysis revealed the inadequacy of conventional forming and finishing processes to achieve the dimensional precision required of downstream decoration operations. The error budget analysis was conducted on a hypothetical 1000 mm×250 mm thin glass substrate. Decoration processes such as screen printing often require tight finished substrate dimensional tolerances (e.g., ±50 μm) to enable precise decoration and to prevent liquid decoration materials (e.g., inks) from contacting smooth, polished edges, causing inks to run and smear. As indicated in the summary error budget analysis in FIG. 4, the most significant contributors to finished thin glass substrate dimensional variation were grinding to size and ion exchange chemical strengthening.

Figure 5:
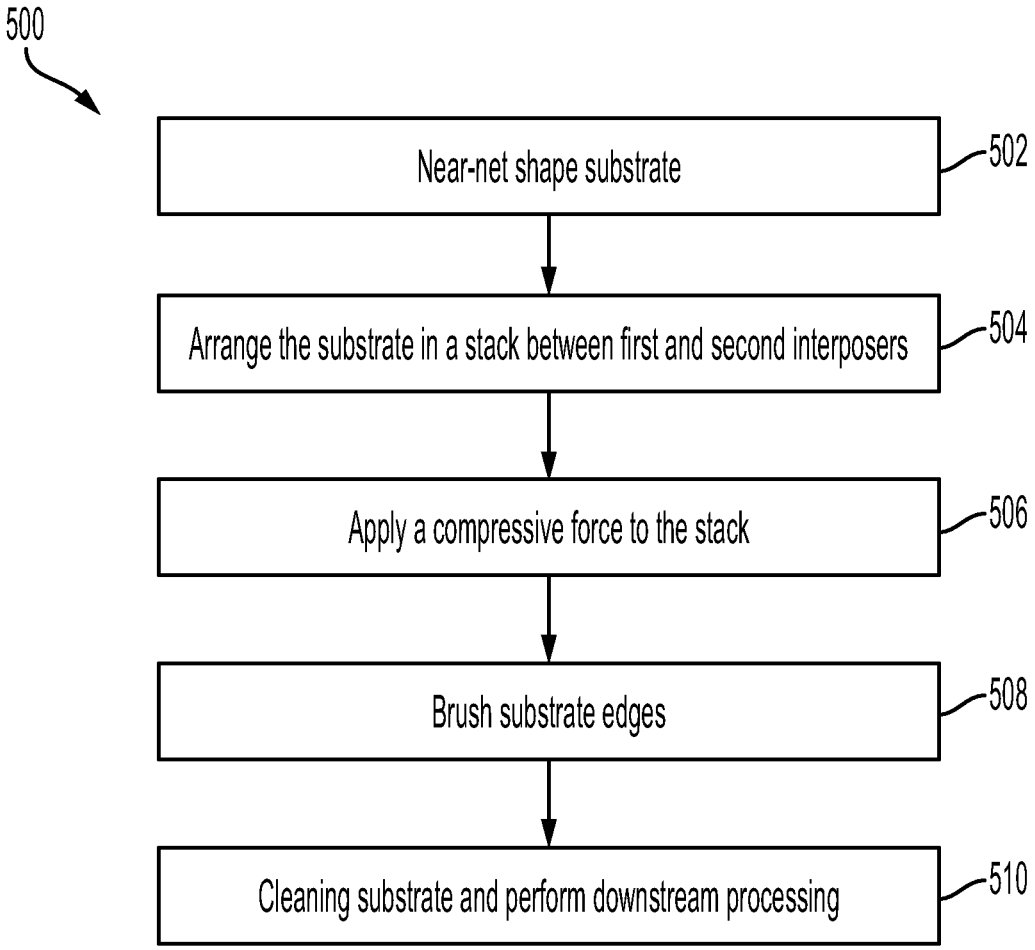
FIG. 5 is a flow diagram of a method of the present disclosure, according to one or more embodiments.

Turning now to FIG. 5, a manufacturing process 500 of the present disclosure is shown, according to one or more embodiments. As shown, the process may include the steps of near-net shaping a substrate 502; arranging the near-net shaped substrate in a stack between first and second interposers 504; applying a compressive force to the stack 506; brushing the substrate edges 508; and cleaning and downstream processing 510. In other embodiments, the process 500 may include additional and/or alternative steps.

The process 500 may be used in the manufacture of relatively thin substrates comprising glass, glass laminate, other laminate, glass composite, silicon, or other relatively brittle materials for use in automotive applications, architectural applications, consumer electronics, and/or other industries. The glass substrate or other substrate may be pre-strengthened. In one or more embodiments, the glass substrate is strengthened and exhibits a compressive stress (CS) region that extends from one or both side surfaces (e.g., side surfaces 712A, 714A of FIG. 7A) to a first depth of compression (DOC). The CS region includes a maximum CS magnitude ($CS_{max}$). The glass substrate has a CT region disposed in the central region that extends from the DOC to an opposing CS region. The CT region defines a maximum CT magnitude ($CT_{max}$). The CS region and the CT region define a stress profile that extends along the thickness of the glass substrate.

In one or more embodiments, the glass substrate may be strengthened mechanically by utilizing a mismatch of the coefficient of thermal expansion between portions of the substrate to create a compressive stress region and a central region exhibiting a tensile stress. In some embodiments, the glass substrate may be strengthened thermally by heating the glass to a temperature above the glass transition point and then rapidly quenching.

In one or more embodiments, the glass substrate may be chemically strengthening by ion exchange. In the ion exchange process, ions at or near the surface of the glass substrate are replaced by—or exchanged with—larger ions having the same valence or oxidation state. In those embodiments in which the glass substrate comprises an alkali-containing glass, ions in the surface layer of the article and the larger ions are monovalent alkali metal cations, such as Li+, Na+, K+, Rb+, and Cs+. Alternatively, monovalent cations in the surface layer may be replaced with monovalent cations other than alkali metal cations, such as Ag+ or the like. In such embodiments, the monovalent ions (or cations) exchanged into the glass substrate generate a stress.

In one or more embodiments, the glass substrate has a CSmax that is about 900 MPa or greater, about 920 MPa or greater, about 940 MPa or greater, about 950 MPa or greater, about 960 MPa or greater, about 980 MPa or greater, about 1000 MPa or greater, about 1020 MPa or greater, about 1040 MPa or greater, about 1050 MPa or greater, about 1060 MPa or greater, about 1080 MPa or greater, about 1100 MPa or greater, about 1120 MPa or greater, about 1140 MPa or greater, about 1150 MPa or greater, about 1160 MPa or greater, about 1180 MPa or greater, about 1200 MPa or greater, about 1220 MPa or greater, about 1240 MPa or greater, about 1250 MPa or greater, about 1260 MPa or greater, about 1280 MPa or greater, or about 1300 MPa or greater. In one or more embodiments, the CSmax is in a range from about 900 MPa to about 1500 MPa, from about 920 MPa to about 1500 MPa, from about 940 MPa to about 1500 MPa, from about 950 MPa to about 1500 MPa, from about 960 MPa to about 1500 MPa, from about 980 MPa to about 1500 MPa, from about 1000 MPa to about 1500 MPa, from about 1020 MPa to about 1500 MPa, from about 1040 MPa to about 1500 MPa, from about 1050 MPa to about 1500 MPa, from about 1060 MPa to about 1500 MPa, from about 1080 MPa to about 1500 MPa, from about 1100 MPa to about 1500 MPa, from about 1120 MPa to about 1500 MPa, from about 1140 MPa to about 1500 MPa, from about 1150 MPa to about 1500 MPa, from about 1160 MPa to about 1500 MPa, from about 1180 MPa to about 1500 MPa, from about 1200 MPa to about 1500 MPa, from about 1220 MPa to about 1500 MPa, from about 1240 MPa to about 1500 MPa, from about 1250 MPa to about 1500 MPa, from about 1260 MPa to about 1500 MPa, from about 1280 MPa to about 1500 MPa, from about 1300 MPa to about 1500 MPa, from about 900 MPa to about 1480 MPa, from about 900 MPa to about 1460 MPa, from about 900 MPa to about 1450 MPa, from about 900 MPa to about 1440 MPa, from about 900 MPa to about 1420 MPa, from about 900 MPa to about 1400 MPa, from about 900 MPa to about 1380 MPa, from about 900 MPa to about 1360 MPa, from about 900 MPa to about 1350 MPa, from about 900 MPa to about 1340 MPa, from about 900 MPa to about 1320 MPa, from about 900 MPa to about 1300 MPa, from about 900 MPa to about 1280 MPa, from about 900 MPa to about 1260 MPa, from about 900 MPa to about 1250 MPa, from about 900 MPa to about 1240 MPa, from about 900 MPa to about 1220 MPa, from about 900 MPa to about 1210 MPa, from about 900 MPa to about 1200 MPa, from about 900 MPa to about 1180 MPa, from about 900 MPa to about 1160 MPa, from about 900 MPa to about 1150 MPa, from about 900 MPa to about 1140 MPa, from about 900 MPa to about 1120 MPa, from about 900 MPa to about 1100 MPa, from about 900 MPa to about 1080 MPa, from about 900 MPa to about 1060 MPa, from about 900 MPa to about 1050 MPa, or from about 950 MPa to about 1050 MPa, or from about 1000 MPa to about 1050 MPa. $CS_{max}$ may be measured at a major surface or may be found at a depth from the major surface within the CS region.

In one or more embodiments, the glass substrate has stress profile a CS magnitude of 800 MPa or greater at a depth within the glass substrate of about 10 micrometers from one or both side surfaces (CS10). In one or more embodiments, the CS10 is about 810 MPa or greater, about 820 MPa or greater, about 830 MPa or greater, about 840 MPa or greater, about 850 MPa or greater, about 860 MPa or greater, about 870 MPa or greater, about 880 MPa or greater, about 890 MPa or greater, or about 900 MPa or greater. In one or more embodiments, the CS10 is in a range from about 800 MPa to about 1000 MPa, from about 825 MPa to about 1000 MPa, from about 850 MPa to about 1000 MPa, from about 875 MPa to about 1000 MPa, from about 900 MPa to about 1000 MPa, from about 925 MPa to about 1000 MPa, from about 950 MPa to about 1000 MPa, from about 800 MPa to about 975 MPa, from about 800 MPa to about 950 MPa, from about 800 MPa to about 925 MPa, from about 800 MPa to about 900 MPa, from about 800 MPa to about 875 MPa, or from about 800 MPa to about 850 MPa.

In one or more embodiments, the glass substrate has a stress profile with a CS magnitude of 700 MPa or greater, or about 750 MPa or greater at a depth within the glass substrate from one or both side surfaces of about 5 micrometers from the first major surface 102 (CS5). In one or more embodiments, the CS5 is about 760 MPa or greater, about 770 MPa or greater, about 775 MPa or greater, about 780 MPa or greater, about 790 MPa or greater, about 800 MPa or greater, about 810 MPa or greater, about 820 MPa or greater, about 825 MPa or greater, or about 830 MPa or greater. In one or more embodiments, the CS5 is in a range from about 700 MPa to about 900 MPa, from about 725 MPa to about 900 MPa, from about 750 MPa to about 900 MPa, from about 775 MPa to about 900 MPa, from about 800 MPa to about 900 MPa, from about 825 MPa to about 900 MPa, from about 850 MPa to about 900 MPa, from about 700 MPa to about 875 MPa, from about 700 MPa to about 850 MPa, from about 700 MPa to about 825 MPa, from about 700 MPa to about 800 MPa, from about 700 MPa to about 775 MPa, from about 750 to about 800 MPa, from about 750 MPa to about 850 MPa, or from about 700 MPa to about 750 MPa.

In one or more embodiments, the CTmax magnitude is about 80 MPa or less, about 78 MPa or less, about 76 MPa or less, about 75 MPa or less, about 74 MPa or less, about 72 MPa or less, about 70 MPa or less, about 68 MPa or less, about 66 MPa or less, about 65 MPa or less, about 64 MPa or less, about 62 MPa or less, about 60 MPa or less, about 58 MPa or less, about 56 MPa or less, about 55 MPa or less, about 54 MPa or less, about 52 MPa or less, or about 50 MPa or less. In one or more embodiments, the CTmax magnitude is in a range from about 40 MPa to about 80 MPa, from about 45 MPa to about 80 MPa, from about 50 MPa to about 80 MPa, from about 55 MPa to about 80 MPa, from about 60 MPa to about 80 MPa, from about 65 MPa to about 80 MPa, from about 70 MPa to about 80 MPa, from about 40 MPa to about 75 MPa, from about 40 MPa to about 70 MPa, from about 40 MPa to about 65 MPa, from about 40 MPa to about 60 MPa, from about 40 MPa to about 55 MPa, or from about 40 MPa to about 50 MPa.

In one or more embodiments, the DOC of the glass substrate is about 0.2*thickness of the glass substrate (0.2*t) or less. For example, DOC may be about 0.18t or less, about 0.18t or less, about 0.16t or less, about 0.15t or less, about 0.14t or less, about 0.12t or less, about 0.1t or less, about 0.08t or less, about 0.06t or less, about 0.05t or less, about 0.04t or less, or about 0.03t or less. In one or more embodiments, DOC is in a range from about 0.02t to about 0.2t, from about 0.04t to about 0.2t, from about 0.05t to about 0.2t, from about 0.06t to about 0.2t, from about 0.08t to about 0.2t, from about 0.1t to about 0.2t, from about 0.12t to about 0.2t, from about 0.14t to about 0.2t, from about 0.15t to about 0.2t, from about 0.16t to about 0.2t, from about 0.02t to about 0.18t, from about 0.02t to about 0.16t, from about 0.02t to about 0.15t, from about 0.02t to about 0.14t, from about 0.02t to about 0.12t, from about 0.02t to about 0.1t, from about 0.02t to about 0.08, from about 0.02t to about 0.06t, from about 0.02t to about 0.05t, from about 0.1t to about 0.8t, from about 0.12t to about 0.16t, or from about 0.14t to about 0.17t.

In one or more embodiments, the glass may be unstrengthened. In some embodiments, the unstrengthened glass comprises an annealed glass.

Exemplary compositions for such glass substrate may include a soda-lime silicate glass composition, an aluminosilicate glass composition, or an alkali aluminosilicate glass composition. In some embodiments, the glass substrate may be or include Corning® Gorilla® Glass, Lotus™ NXT, Eagle XG® glass, Willow® Glass, and/or any other glass types and other brittle materials.

The glass substrate may have a thickness in a range from about 0.1 mm to about 6 mm or that is in a range from about 0.1 mm to about 1.5 mm. For example, glass substrate may have a thickness that is greater than about 0.125 mm (e.g., about 0.13 mm or greater, about 0.13 mm or greater, about 0.13 mm or greater, about 0.13 mm or greater, about 0.13 mm or greater, about 0.13 mm or greater, about 0.13 mm or greater, about 0.13 mm or greater, about 0.13 mm or greater, about 0.13 mm or greater, about 0.13 mm or greater, about 0.13 mm or greater, about 0.13 mm or greater, about 0.13 mm or greater). In one or more embodiments, the glass substrate thickness may be in a range from about 0.01 mm to about 1.5 mm, 0.02 mm to about 1.5 mm, 0.03 mm to about 1.5 mm, 0.04 mm to about 1.5 mm, 0.05 mm to about 1.5 mm, 0.06 mm to about 1.5 mm, 0.07 mm to about 1.5 mm, 0.08 mm to about 1.5 mm, 0.09 mm to about 1.5 mm, 0.1 mm to about 1.5 mm, from about 0.15 mm to about 1.5 mm, from about 0.2 mm to about 1.5 mm, from about 0.25 mm to about 1.5 mm, from about 0.3 mm to about 1.5 mm, from about 0.35 mm to about 1.5 mm, from about 0.4 mm to about 1.5 mm, from about 0.45 mm to about 1.5 mm, from about 0.5 mm to about 1.5 mm, from about 0.55 mm to about 1.5 mm, from about 0.6 mm to about 1.5 mm, from about 0.65 mm to about 1.5 mm, from about 0.7 mm to about 1.5 mm, from about 0.01 mm to about 1.4 mm, from about 0.01 mm to about 1.3 mm, from about 0.01 mm to about 1.2 mm, from about 0.01 mm to about 1.1 mm, from about 0.01 mm to about 1.05 mm, from about 0.01 mm to about 1 mm, from about 0.01 mm to about 0.95 mm, from about 0.01 mm to about 0.9 mm, from about 0.01 mm to about 0.85 mm, from about 0.01 mm to about 0.8 mm, from about 0.01 mm to about 0.75 mm, from about 0.01 mm to about 0.7 mm, from about 0.01 mm to about 0.65 mm, from about 0.01 mm to about 0.6 mm, from about 0.01 mm to about 0.55 mm, from about 0.01 mm to about 0.5 mm, from about 0.01 mm to about 0.4 mm, from about 0.01 mm to about 0.3 mm, from about 0.01 mm to about 0.2 mm, from about 0.01 mm to about 0.1 mm, from about 0.04 mm to about 0.07 mm, from about 0.1 mm to about 1.4 mm, from about 0.1 mm to about 1.3 mm, from about 0.1 mm to about 1.2 mm, from about 0.1 mm to about 1.1 mm, from about 0.1 mm to about 1.05 mm, from about 0.1 mm to about 1 mm, from about 0.1 mm to about 0.95 mm, from about 0.1 mm to about 0.9 mm, from about 0.1 mm to about 0.85 mm, from about 0.1 mm to about 0.8 mm, from about 0.1 mm to about 0.75 mm, from about 0.1 mm to about 0.7 mm, from about 0.1 mm to about 0.65 mm, from about 0.1 mm to about 0.6 mm, from about 0.1 mm to about 0.55 mm, from about 0.1 mm to about 0.5 mm, from about 0.1 mm to about 0.4 mm, or from about 0.3 mm to about 0.7 mm.

In one or more embodiments, the glass substrate has a width in a range from about 5 cm to about 250 cm, from about 10 cm to about 250 cm, from about 15 cm to about 250 cm, from about 20 cm to about 250 cm, from about 25 cm to about 250 cm, from about 30 cm to about 250 cm, from about 35 cm to about 250 cm, from about 40 cm to about 250 cm, from about 45 cm to about 250 cm, from about 50 cm to about 250 cm, from about 55 cm to about 250 cm, from about 60 cm to about 250 cm, from about 65 cm to about 250 cm, from about 70 cm to about 250 cm, from about 75 cm to about 250 cm, from about 80 cm to about 250 cm, from about 85 cm to about 250 cm, from about 90 cm to about 250 cm, from about 95 cm to about 250 cm, from about 100 cm to about 250 cm, from about 110 cm to about 250 cm, from about 120 cm to about 250 cm, from about 130 cm to about 250 cm, from about 140 cm to about 250 cm, from about 150 cm to about 250 cm, from about 5 cm to about 240 cm, from about 5 cm to about 230 cm, from about 5 cm to about 220 cm, from about 5 cm to about 210 cm, from about 5 cm to about 200 cm, from about 5 cm to about 190 cm, from about 5 cm to about 180 cm, from about 5 cm to about 170 cm, from about 5 cm to about 160 cm, from about 5 cm to about 150 cm, from about 5 cm to about 140 cm, from about 5 cm to about 130 cm, from about 5 cm to about 120 cm, from about 5 cm to about 110 cm, from about 5 cm to about 110 cm, from about 5 cm to about 100 cm, from about 5 cm to about 90 cm, from about 5 cm to about 80 cm, or from about 5 cm to about 75 cm.

In one or more embodiments, the glass substrate has a length in a range from about 5 cm to about 250 cm, from about 10 cm to about 250 cm, from about 15 cm to about 250 cm, from about 20 cm to about 250 cm, from about 25 cm to about 250 cm, from about 30 cm to about 250 cm, from about 35 cm to about 250 cm, from about 40 cm to about 250 cm, from about 45 cm to about 250 cm, from about 50 cm to about 250 cm, from about 55 cm to about 250 cm, from about 60 cm to about 250 cm, from about 65 cm to about 250 cm, from about 70 cm to about 250 cm, from about 75 cm to about 250 cm, from about 80 cm to about 250 cm, from about 85 cm to about 250 cm, from about 90 cm to about 250 cm, from about 95 cm to about 250 cm, from about 100 cm to about 250 cm, from about 110 cm to about 250 cm, from about 120 cm to about 250 cm, from about 130 cm to about 250 cm, from about 140 cm to about 250 cm, from about 150 cm to about 250 cm, from about 5 cm to about 240 cm, from about 5 cm to about 230 cm, from about 5 cm to about 220 cm, from about 5 cm to about 210 cm, from about 5 cm to about 200 cm, from about 5 cm to about 190 cm, from about 5 cm to about 180 cm, from about 5 cm to about 170 cm, from about 5 cm to about 160 cm, from about 5 cm to about 150 cm, from about 5 cm to about 140 cm, from about 5 cm to about 130 cm, from about 5 cm to about 120 cm, from about 5 cm to about 110 cm, from about 5 cm to about 110 cm, from about 5 cm to about 100 cm, from about 5 cm to about 90 cm, from about 5 cm to about 80 cm, or from about 5 cm to about 75 cm.

In some embodiments, the substrate may be or include a relatively thin steel laminate or other thin laminate product. The substrate may additionally or alternatively be coated, decorated, or otherwise pre-treated. For example, the substrate may be coated with one or more inks or thin films. In some embodiments, such decorations may be applied prior to near-net shaping. Additionally or alternatively, a decoration layer may be applied after near-net shaping and/or at any other suitable point in the manufacturing process. Each of the process steps 502-510 will be described in more detail below with reference to the additional drawings.

The substrate may be near-net shaped 502 using any suitable method. For example, the substrate may be near-net shaped using a mechanical score and break process wherein a larger sheet of glass or other substrate is scored with an outline of the component to be formed and finished, and the component is mechanically separated from the larger sheet along the score line. In other embodiments, near-net shaping may be performed by nano-perforation and thermal separation, using for example, lasers supplied by Corning Laser Technologies (CLT). In some embodiments, near-net shaping may include a first step of nanoperforation via, for example, Crack Propagation Control (CPC) technology and a second step of thermal separation via a $CO_2$ laser or other suitable laser device. In other embodiments, near-net shaping may include nanoperforation (such as via CPC) and self-separation. In some embodiments, the substrate may be edge profiled during near-net shaping, or as part of a near-net shaping step. For example, laser edge chamfering technology may be used to simultaneously near-net shape and edge profile the substrate. Strengthening, decoration, coating, and/or other treatments may be performed prior to edge forming and finishing in some embodiments.

The near-net shaped substrate may be arranged between a first interposer and a second interposer 504. Each interposer may be sized and shaped similar to the substrate. The interposers may be configured to separate adjacent substrates, and may additionally be configured to expose and protect desired areas or portions of substrate edges so as to direct brush filaments during brushing operations. In some embodiments, a plurality of substrates may be aligned and arranged in a stacked configuration with interposers arranged between individual substrates.

Figure 6A:
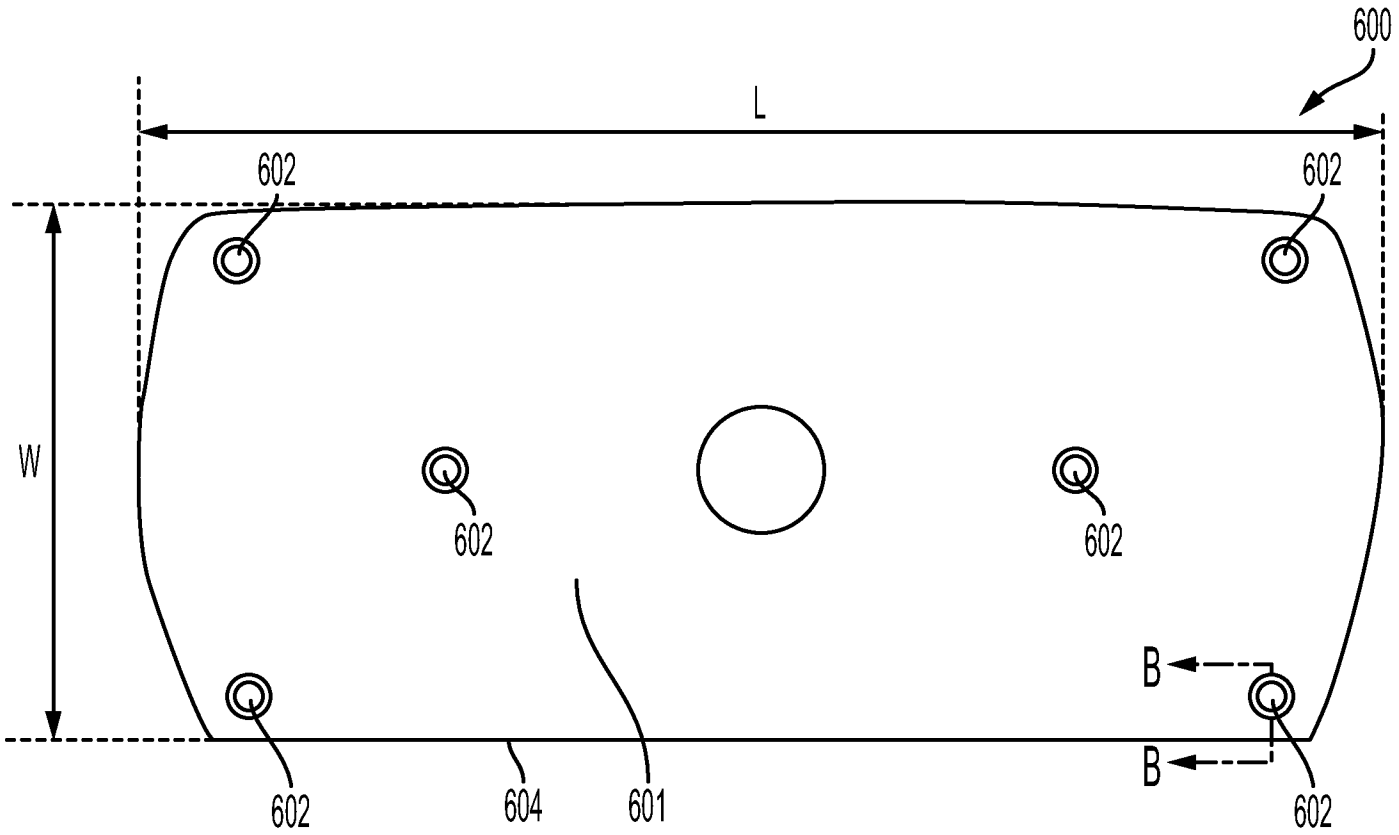
FIG. 6A is a front view of a substrate of the present disclosure, according to one or more embodiments.
Figure 6B:
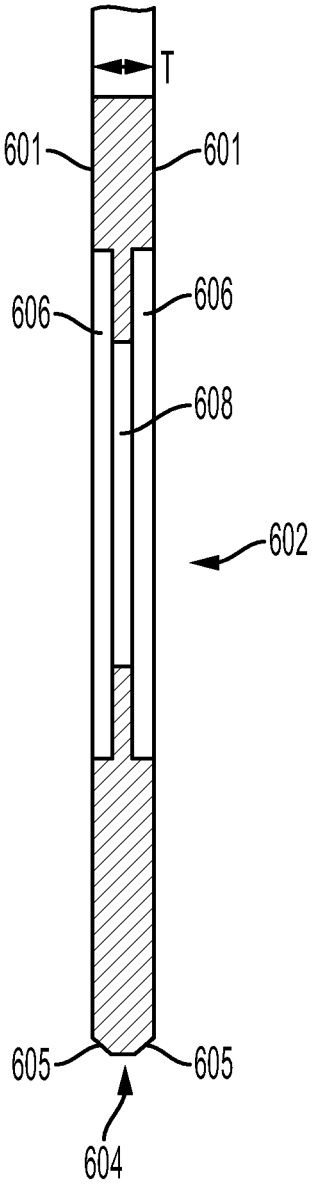
FIG. 6B is a cross-sectional end view of a portion of a substrate of the present disclosure, according to one or more embodiments.

FIGS. 6A-6B show an example of an interposer 600 of the present disclosure, according to one or more embodiments. The interposer 600 may have a planar shape with first and second side surfaces 601. The interposer 600 may be sized and shaped to correspond with a particular substrate to be formed and finished. While the interposer 600 shown with respect to FIG. 6 has a generally rectangular perimeter shape, it is to be appreciated that an interposer of the present disclosure may have any other suitable perimeter shape configured to align with a substrate to be formed and finished. For example, where the substrate to be formed and finished has a circular perimeter shape, the corresponding interposer may also have a circular perimeter shape. With reference to the overhead view of FIG. 6A, the interposer 600 may have a length L, measured along a first side of the interposer, and a width W, measured along a second side and perpendicular to the length. The length and width may be sized to equal to, substantially equal to, or may be similar to a length and width of a corresponding substrate.

For example, in some embodiments, the interposer 600 may have a length L sized to match a desired finished length of a corresponding substrate to be formed and finished. That is, where the finished substrate is configured to have a final length of 100 mm, for example, the corresponding interposer may additionally have a length L of 100 mm. In other embodiments, the interposer 600 may have a length L that is slightly smaller than a desired finished length of a corresponding substrate to be formed and finished. For example, where the substrate is configured to have a final length of 100 mm, the corresponding interposer may have a length L of 99 mm, 98 mm, 97 mm, 96 mm, 95 mm, or a different length. In this way, the interposer 600 may be sized to expose more substrate material to brushing operations, as described in more detail below. In still other embodiments, the interposer 600 may have a length L sized to be larger than a desired finished length of a corresponding substrate. The width W of the interposer may additionally be sized to match, be smaller than, or be larger than a desired finished width of a corresponding substrate to be formed and finished. In some embodiments, the length L of the interposer 600 may range between approximately 50 mm and approximately 1500 mm, and the width W may range between approximately 50 mm and approximately 500 mm. In other embodiments, the interposer 600 may have smaller or larger dimensions sized to correspond with the particular substrate (s) to be processed.

As shown in FIG. 6B, the interposer may have a thickness T, measured perpendicular to each of the width W and length L. In some embodiments, the thickness T may be between approximately 0.01 and approximately 10 times a thickness of a corresponding substrate to be formed and finished. For example, where a substrate to be formed and finished has a thickness of 1 mm, the interposer 600 may have a thickness T of between approximately 0.01 mm and approximately 10 mm. The thickness T of the interposer 600 may be sized to control exposure of substrate material to brush filaments, as described below.

The interposer 600 may have a perimeter or outer edge surface 604 having a defined profile shape. The profile shape may be configured for directing brush filaments to desired portions of the substrate, as described in more detail below, to achieve a desired substrate edge profile shape. The profile shape of the interposer edge 604 may be a chamfered edge and with two chamfered corners 605, as shown for example in FIG. 6B. Each chamfered corner 605 may define a sloped or tapered surface between a side surface 601 of the interposer 600 and an outermost portion of the edge surface 604. The chamfered corners 605 may have a 45-degree chamfer angle or any other suitable chamfer angle. In other embodiments, the interposer edge 604 may have a beveled, radiused, square, or other suitable edge profile shape. In some embodiments, the interposer edge 604 may be shaped to achieve different edge profiles on two substrates arranged above and below the interposer, respectively. For example, the interposer edge 604 may a chamfered corner 605 arranged along a first side surface 601 of the interposer 600 and a second opposing corner may be squared, with a 90-degree angle to a second side surface of the interposer. In this way, the interposer 600 may direct brush bristles differently at the two corners of the edge 604.

The interposer 600 may be constructed of Polytetrafluoroethylene (PTFE) in some embodiments. The interposer 600 may additionally or alternatively include one or more paper materials, one or more plastics, neoprene, silicone, elastomer materials, and/or other suitable materials. The interposer 600 may be constructed with materials configured to be resistant to relatively harsh chemistries (e.g., acidity, alkalinity), capable of withstanding processing temperature extremes, relatively soft where the range of polymeric materials is concerned, and non-marking with respect to the substrate surface. In some embodiments, the interposer 600 may be constructed of one or more materials having a pH of between approximately 6.0 and 11.0, or between approximately 7.0 and approximately 9.0. Interposer material(s) may additionally be configured to be readily machined and configured to possess a relatively high degree of mechanical rigidity enabling robotic handling. Interposer material(s) may be configured to be easily cleaned and reused. Interposer material(s) may be configured to be non-marking, such that the interposer does not leave markings on substrates. In some embodiments, interposer material(s) may be relatively soft and may be configured to expand laterally when compressed. Interposer material(s) may be configured to form a seal, which may be a liquid impermeable seal, against substrate materials. Such a seal may be configured to prevent the polishing slurry from flowing onto the substrate beyond the exposed portions, and/or may be configured to distribute the compressive force applied to the substrate/interposer stack to prevent crushing of the substrate.

In some embodiments, the interposer 600 may have one or more through holes 602 extending between the two side surfaces 601. The interposer 600 may have between 1 and 10, or more, through holes 602 symmetrically or otherwise strategically spaced across the interposer. In some embodiments, each through hole 602 may be a counterbored, or countersunk, through hole having a double-chambered cross-sectional shape. Each through hole 602 may have first and second chambers 606 each having a depth extending into first and second sides 601 of the interposer, respectively, and a channel 608 extending between the chambers. The channel 608 may have a width or diameter smaller than that of the chambers 606. In other embodiments, the through holes 602 may have a constant width or diameter, or may have any other suitable cross-sectional shape. In some embodiments, the through holes 602 may each be configured to receive a stabilizer or stabilizing material. Stabilizers or stabilizing material may include one or more rubbers or other moldable materials configured to have a higher coefficient of friction against the substrate material, as compared with the surrounding interposer material. In some embodiments, the stabilizers may be readily removable from the through holes 602. In some embodiments, arranging the substrate between a first and second interposer may include placing a stabilizer or stabilizing material into each through hole 602 before, during, or after each interposer is arranged in the stack. However, in other embodiments, interposers 600 may be employed without a stabilizer or stabilizing material arranged in the through holes 602.

It is to be appreciated that the interposer 600 may be sized and shaped to correspond with a substrate or plurality of substrates to be formed and finished. In at least one embodiment, the interposer 600 may have a length L of between approximately 100 mm and approximately 1000 mm, and a width W of between approximately 30 mm and approximately 300 mm. The interposer 600 may have a thickness T of between approximately 0.1 mm and approximately 10 mm. Through holes 602 may have a width or diameter of between approximately 1 mm and approximately 20 mm. However, in other embodiments, interposers 600 may have any other suitable dimensions sized to correspond with substrate(s) to be finished. The interposer 600 may be sized with a length L and width W that is equal to, or slightly smaller than, or slightly larger than, a desired length and width of the substrate(s) to be finished. In some embodiments, the interposer 600 may have a length configured to be between 0.1-10 mm smaller than a finished substrate length, and a width configured to be between 0.1-10 mm smaller than a finished substrate width. In other embodiments, the interposer 600 may have other suitable dimensions relative to the substrate(s).

In some embodiments, a plurality of substrates may be arranged in a stack with an interposer arranged between each adjacent pair of substrates. The substrates may each have a same desired finished shape and size. In this way, a plurality of substrates arranged in a stack may have their edges formed and finished simultaneously in a batch process. In some embodiments, up to 5, up to 10, up to 20, up to 50, up to 100, up to 200, up to 300, up to 400, or up to 500 substrates may be arranged together in a stack with interposers arranged between each pair of substrates. In other embodiments, more or fewer substrates may be arranged together in a stack for batch processing. Endcaps or chucks may be arranged at each end (e.g., top and bottom) of the part stack in some embodiments. Endcaps or chucks may be constructed of one or more metals or other suitable materials. In some embodiments, interposers may be screen printed directly onto substrates. For example, a first substrate may be positioned in a stack, an interposer having desired shape and dimensions may be screen printed directly onto a side surface of the substrate, and a second substrate may be arranged in the stack over the printed interposer. In such embodiments, the interposers may be mechanically and/or chemically removed after brushing operations.

With reference back to FIG. 5, a compressive force may be applied to the substrate and interposers 506. For example, where the substrate is arranged between first and second interposers, a compressive force may be applied to the first interposer, so as to compress the substrate and interposers from a first side, to the second interposer, so as to compress the substrate and interposers from a second side, or to both the first and second interposers. The compressive force may be applied using any suitable means and may range between approximately 1 psi and approximately 1000 psi. In some embodiments, the magnitude of pressure or force applied to the stack may depend on the dimensions and/or number of substrates. For example, where one or more substrates in the stack have a length and width of 100 mm, a compressive force of between approximately 650-700 psi may be applied to the stack. As another example, where one or more substrates in a stack are square shaped with a diagonal length of 635 mm, a compressive force of between approximately 30-40 psi may be applied to the stack. It is to be appreciated that the compressive force may be applied with a surface area large enough to distribute the compressive force and not cause cracking or breakage of the substrate. The compressive force may be configured to hold the substrate and interposers together in a stack and generally prevent slippage or twisting of the components with respect to one another. The compressive fore may be applied using any suitable means. In some embodiments, for example, a clamp may be arranged on the stack and a nut or bolt may be tightened to apply the desired force.

Brushing the substrate edges 508 may include contacting an edge of the substrate with a brush and a polishing material or slurry. The brush and slurry may be configured to polish an edge surface of the substrate in order to remove chips, cuts, or other flaws. Additionally, in some embodiments, the brush and slurry may be configured to simultaneously shape the edge surface of the substrate by mechanically and/or chemically removing substrate material to achieve a desired shape.

The brush may be sized to correspond with the stack of substrates and may have a plurality of bristles or filaments extending from a base portion. Brush filaments may be constructed of one or more polymeric, resin materials, or carbon fiber materials in some embodiments. In other embodiments, other suitable filament materials may be used. Additionally, brush filaments may each have a diameter of not more than 0.500 mm or not more than 0.200 mm in some embodiments. In some embodiments, brush filaments may have a diameter of between approximately 0.100 mm and approximately 0.500 mm. Filaments may have a circular or polygonal cross-sectional shape in some embodiments. Brush filaments may have a length of between approximately 1 mm and approximately 200 mm. Filaments of a brush may have varied lengths and/or varied diameters in some embodiments. Moreover, brush filaments may be arranged in discrete tufts or bundles, each tuft or bundle having a diameter of between approximately 1.0 mm and approximately 10.0 mm. Individual filaments or tufts of filaments may be arranged in a particular pattern on the brush base. For example, bundles or tufts may be arranged in a straight, spiral, staggered, random or other pattern. Additionally, a brush may have a brush density (or filament density) of between approximately 10% and approximately 95%, or between approximately 30% and approximately 90%, or between approximately 50% and approximately 85%. In at least one embodiment, a brush of the present disclosure may have a brush density of approximately 68.5%. In other embodiments, filaments and tufts may have any other suitable sizing and configuration.

In some embodiments, the brush may be a rotary brush configured to rotate about a central longitudinal axis. In some embodiments, the rotary brush may be configured to rotate about its central axis while it is moved laterally along an edge of the substrate, while the substrate and interposer stack is fixed. In other embodiments, the substrate stack may additionally or alternatively be configured to rotate about a central axis of the stack, which may be parallel to the rotation axis of the brush. In some embodiments, the brushing step may be performed by rotating the brush in a first direction and additionally rotating the substrate and interposer stack in an opposing second direction. This may be particularly useful where the substrate(s) have a round planar shape. It is to be appreciated that a brushing process of the present disclosure may operate to polish an entire perimeter edge of a substrate using a single pass polar motion, and without a need for corner dwelling or rounding motions.

The brush may be operated to apply a polishing material or slurry to the substrate. The polishing material or slurry may be configured to chemically and/or mechanically remove substrate material to simultaneously shape and/or polish an edge surface of the substrate. In some embodiments, the polishing material may be or include an abrasive slurry, such as a cerium oxide or diamond slurry. In some embodiments, the polishing material may include cerium oxide or another abrasive or chemical abrasive with a grain size of between approximately 0.01 micrometers and approximately 15.0 micrometers, or between 0.05 and 7.0 micrometers, between 0.1 and 1.0 micrometers, or between 0.1 and 0.5 micrometers. In at least one embodiment, the polishing material may have a cerium oxide or other abrasives or chemical abrasives having a grain size of between approximately 0.1 and approximately 0.3 micrometers. The cerium oxide slurry or other polishing material may have an alkalinity ranging from a pH of 6 to a pH of 11. In at least one embodiment, the polishing material may include a DND Dia-Sol Nanodiamond in 50 ct/liter with a diamond abrasive size ranging from approximately 30 nm to approximately 100 micrometers. Other polishing materials, including chemical and/or mechanical polishing materials may be used in other embodiments. In some embodiments, multiple polishing materials may be used consecutively or simultaneously.

In some embodiments, the brush may be configured for receiving and distributing the polishing material. For example, the brush base from which brush filaments extend may have perforations or channels configured for ejecting polishing material from the brush base onto the filaments and substrate. Perforations may be distributed throughout the brush base. Polishing material may be expelled through the perforations via an extrusion system or via centripetal force of a rotating brush. Perforations may have a circular, polygonal, or any other suitable cross-sectional shape with any diameter suitable for achieving a desired flow rate of a polishing material having a defined viscosity. In some embodiments, the brush base may have a rotary union configured to enable continuous polishing material recharging from an external source as needed.

During the brushing operation, the brush may be driven at a speed of between approximately 10 and approximately 1000 rpm. Additionally, in some embodiments, a brush may be driven with a linear speed along an edge of the substrates of between approximately 1 and approximately 1000 m/min. The brush may be arranged such that a butting distance between the substrate edge and brush filaments is maintained at between approximately 0.1 and approximately 10.0 mm. In some embodiments, butting distance may be varied, such as with each pass of the brush. In some embodiments, a first butting distance may be configured to achieve material removal for edge forming, while a second butting distance may be configured to achieve edge polishing. In this way, each pass of the brush may be directed primarily toward shaping or primarily toward polishing, depending on the butting distance. Brushing may be performed until a desired edge profile is achieved and until a maximum flaw size or average flaw size on the substrate edge is reduced to less than 3 micrometers, less than 2 micrometers, or less than 1 micrometer. The brushing step may operate to form a desired edge shape of the substrate, which may be a chamfered, beveled, radiused, or other suitable edge profile or shape, and to simultaneously polish the substrate edge.

In some embodiments, the brushing step may include a single stage brushing step. That is, in some embodiments, a single brush may be used with a suitable number of passes over the edge surface to both shape and polish the edges. In other embodiments, brushing may be performed in multiple steps using, for example, more than one brush and/or more than one polishing material. For example, a first brushing step may be performed using a first brush and polishing material having a first grain size, and a second brushing step may be performed using the brush and a polishing material having a second, smaller grain size. As a particular example, a second brushing step may include brushing substrate edges with a fine polishing cerium oxide slurry having a grain size of between approximately 0.1 micrometers and approximately 0.5 micrometers.

During the brushing step, the interposers may operate to direct the brush filaments to remove substrate material into a desired edge profile or shape. In particular, the interposers may be configured to expose a desired amount of the substrate edge to the brush surface, such that a desired amount of the substrate edge may be subject to material removal from the brushing step.

Figure 7A:
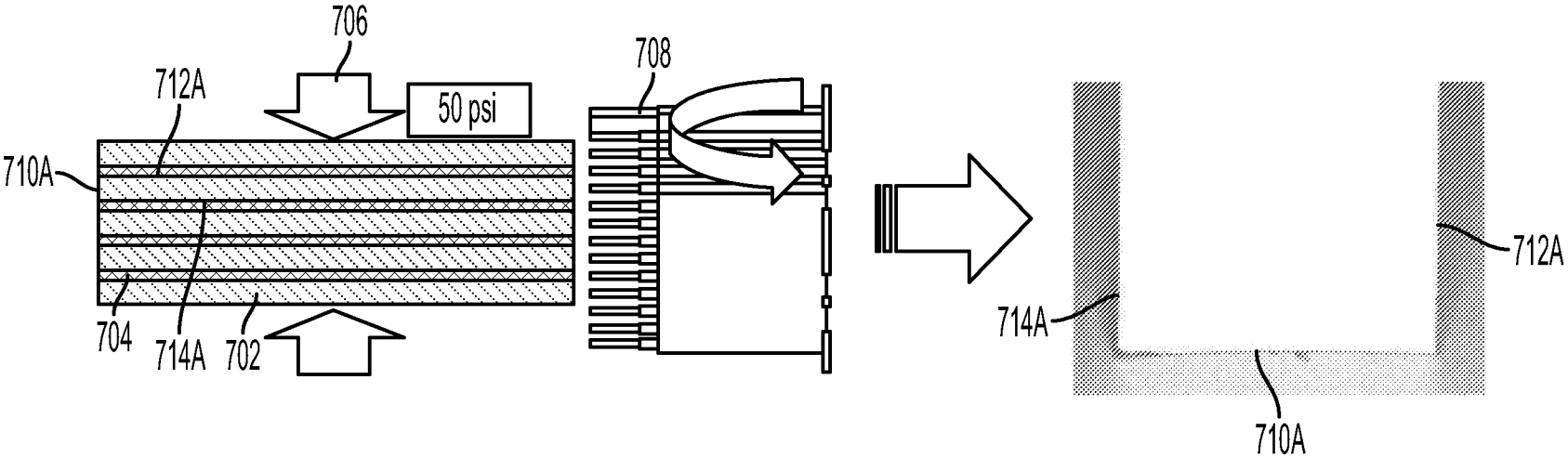
FIG. 7A is a cross-sectional diagram of a brushing operation of the present disclosure, according to one or more embodiments.

For example, FIG. 7A shows one embodiment of a stack of substrates 702 (which may include one or more embodiments of the glass substrates described herein) with an interposer 704 arranged between each pair of adjacent substrates. As shown, a compressive force 706 may be applied to the stack, and edges of the substrates may be exposed to a brush 708. As shown in 7A, in some embodiments, an interposer 704 may be sized with a width and/or length equaling, or substantially equaling, a width and/or length of the substrates 702. As a result of the equal or substantially equal sizing of the interposers 704 to the substrates 702, the interposers may ensure that only a perpendicular edge surface 710A of the substrates is exposed to the brush 708, while protecting opposing side surfaces 712A, 714A from the brush. As further shown in FIG. 7A, the simultaneous brushing and polishing step may thus produce substrates having a squared, or perpendicular, edge profile shape of edge 710A.

Figure 7B:
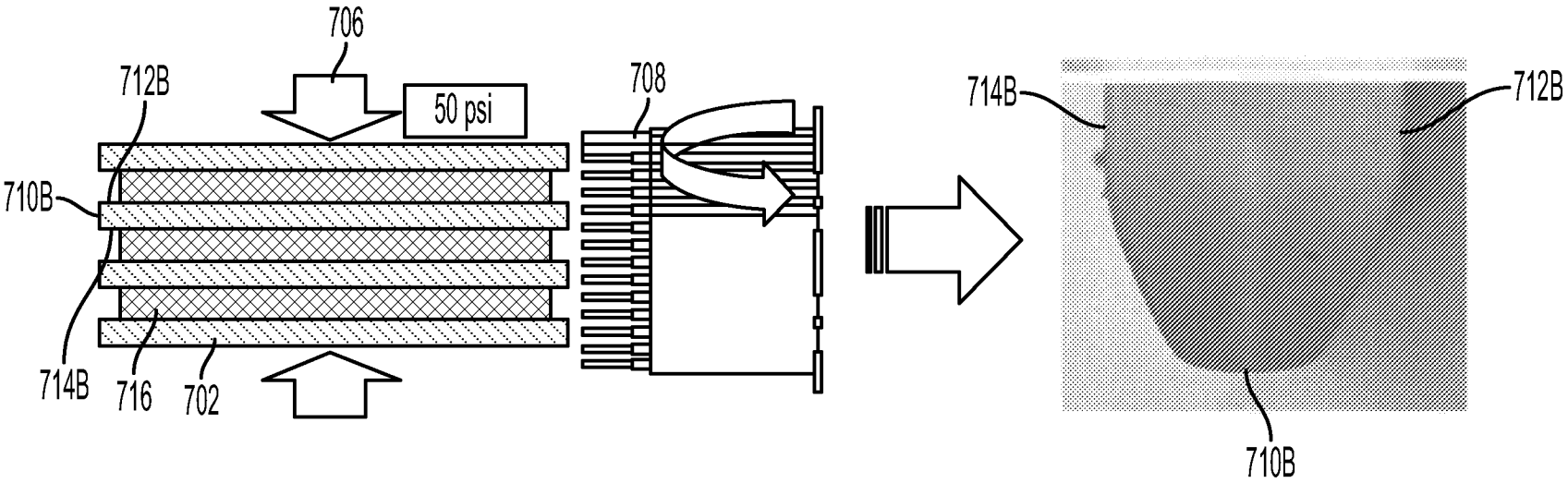
FIG. 7B is a cross-sectional diagram of another brushing operation of the present disclosure, according to one or more embodiments.

As another example, FIG. 7B shows a stack of substrates 702 with an interposer 716 arranged between each pair of adjacent substrates. Each interposer 716 may have a width and/or length smaller than that of the substrates 702, and thus configured to expose more of the substrate surfaces to the brush 708. In particular, the shortened width and/or length of the interposer 716 may cause a portion of the opposing side surfaces 712B, 714B to be exposed to the brush 708, in addition to the edge surface 710B of each substrate. Exposing the edge surface in this way may allow the brush and polishing material to remove more substrate material, as compared with the material removal of FIG. 7A. As shown in FIG. 7B, exposing a portion of the opposing side surfaces 712B, 714B may cause the brushing step to form a chamfered edge profile shape of edge 710B. As may be appreciated from FIG. 7B, a thickness of the interposers 716 may additionally affect an amount of substrate that is exposed to the brush 708. A relatively thick interposer 716 may allow the brush filaments to more easily reach the exposed side surfaces 712B, 714B of the substrates, whereas relatively thinner substrates may protect the side surfaces more by reducing exposure to the brush filaments.

Figure 7C:
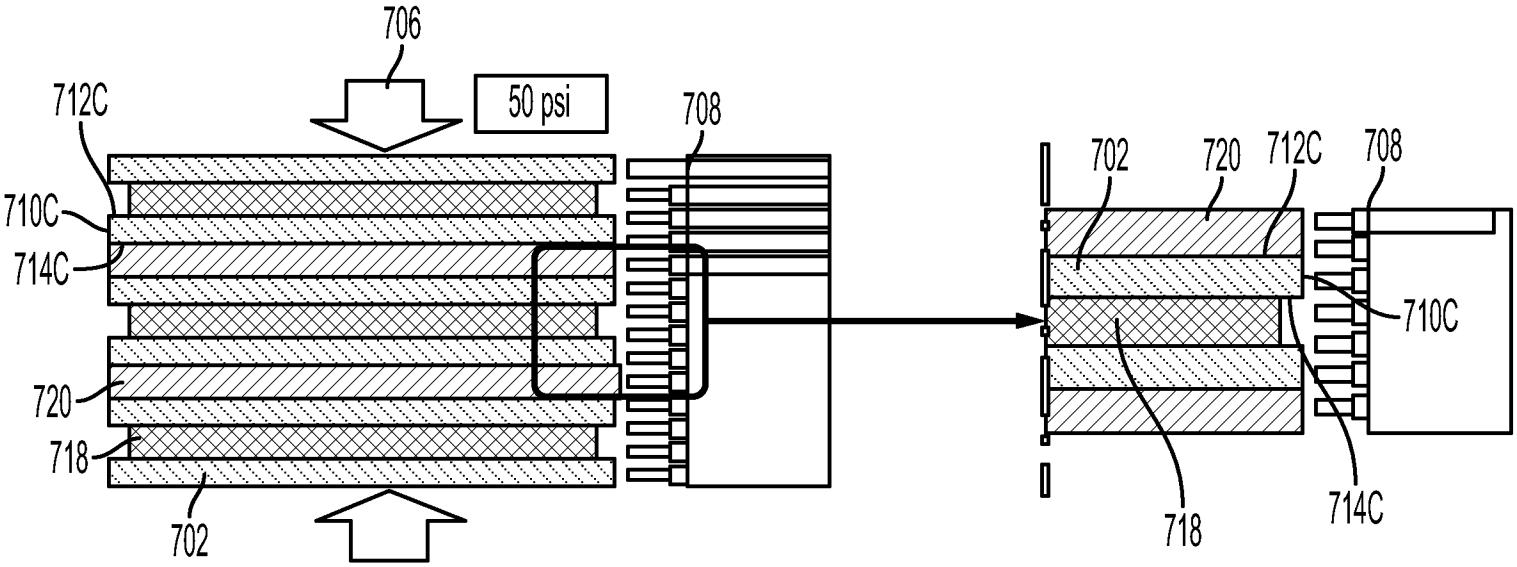
FIG. 7C is a cross-sectional diagram of another brushing operation of the present disclosure, according to one or more embodiments.

In some embodiments, interposers may be used to produce an asymmetric edge profile of a substrate. For example, one or more substrates may be spaced apart by differently sized and/or differently shaped interposers. FIG. 7C shows a stack of substrates 702 spaced apart with interposers 718 having a first size and interposers 720 having a second size. In some embodiments, the second size may be larger than the first size. In particular, the interposers 720 may have a width and/or length larger than a width and/or length of the interposers 718. The interposers 718, 720 may be arranged such that each substrate 702 in the stack may have an interposer of the first size 718 arranged on one side of the substrate and an interposer of the second size 720 arranged on an opposing side of the substrate. Thus, the interposer of the smaller size 718 may provide for an exposed side surface, or a larger portion of exposed side surface, of each substrate 702, as compared with the interposer of the larger size 720. Thus, for each substrate 702, the differently sized interposers 718, 720 may direct filaments of the brush 708 to create an asymmetric edge. Where the smaller interposer 718 is arranged, the substrate 702 may have a chamfered edge profile shape (similar to that shown in FIG. 7B), and where the larger interposer 718 is arranged, the substrate may have a squared edge profile shape (similar to that shown in FIG. 7A).

Figure 7D:
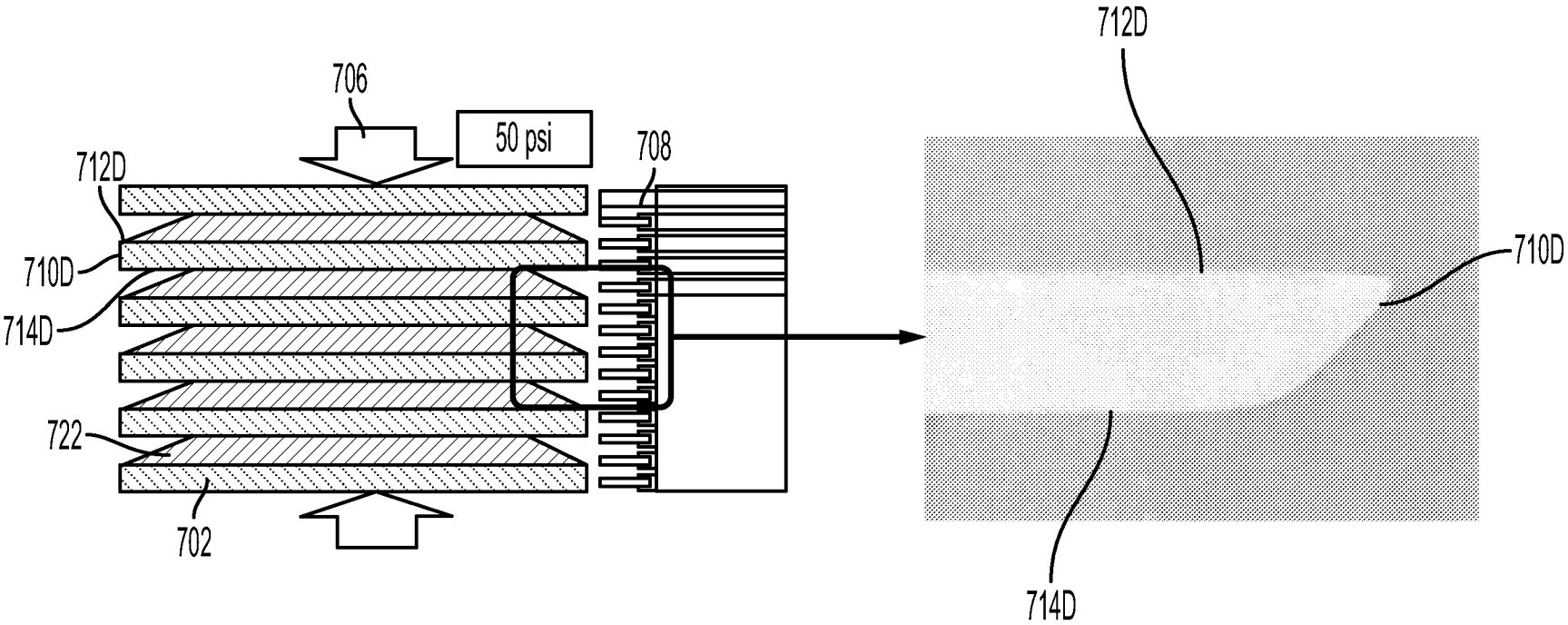
FIG. 7D is a cross-sectional diagram of another brushing operation of the present disclosure, according to one or more embodiments.

In other embodiments, an asymmetric edge profile of a substrate may be achieved with interposers having an asymmetric edge. FIG. 7D shows a stack of substrates 702 spaced apart with interposers 722. Each interposer 722 may have an angled edge profile, and may have a generally trapezoidal cross-sectional shape. For example, each interposer 722 may have a first width, which may be or be substantially similar to a width of the substrates 702. The interposers 722 may each taper from the first width to a second width, smaller than the first width. The second width may be configured to expose a portion of side surface 714D of an adjacent substrate 702. In this way, in a stacked configuration as shown in FIG. 7D, each substrate 702 may have a first side arranged adjacent a first width of an interposer 722 and a second side arranged adjacent a second width of another interposer. The angled interposer edges may direct filaments of the brush 708 to produce an angled or tapered edge profile shape of edge 710D, as shown in FIG. 7D.

Figure 7E:
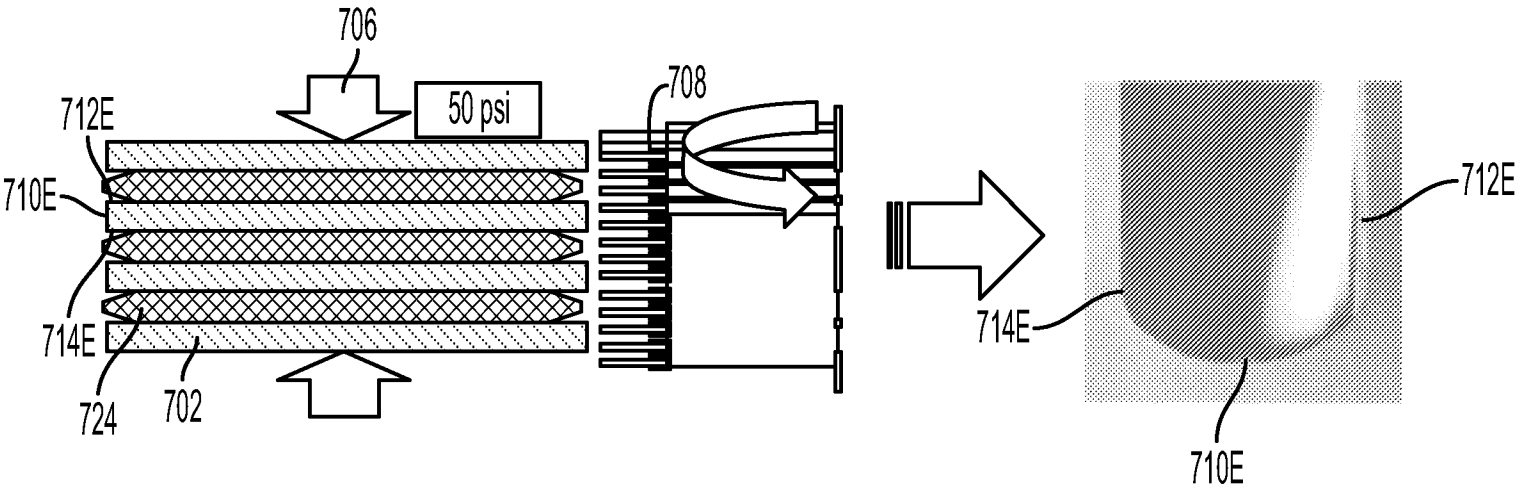
FIG. 7E is a cross-sectional diagram of another brushing operation of the present disclosure, according to one or more embodiments.

In other embodiments, interposers may have other edge profile shapes. For example, FIG. 7E shows a stack of substrates 702 interwoven with interposers 724, each interposer having a double chamfered edge shape. The double chamfered edge may extend to a largest width or length, which may equal or substantially equal a width or length of the substrates 702, and may taper inward on each side of the edge toward a second, smaller width or length. The double chamfered edge of the interposer 724 may expose a portion of the substrate sides 712E, 714E to brushing. The double chamfered edge of each interposer 724 may thus direct filaments of the brush 708 to form a rounded or curved edge profile shape of edge 710E, as shown in FIG. 7E.

It is thus to be appreciated that interposers of the present disclosure may have any suitable length and width, thickness, and edge profile shape configured to achieve a desired substrate edge profile. The interposers may be configured to expose a particular area or amount of substrate to the brushing and/or to protect other areas, so as to guide or direct contact between brush filaments and the substrates. In this way, the interposers may channel any defects caused by brushing onto the substrate edge, rather than allowing defects to be formed on the substrate surface.

With reference back to FIG. 5, the process 500 may include cleaning and/or downstream processing steps 510. For example, after the brushing step is completed and the substrate edges are shaped and polished, the substrate may be removed from the interposer stack, and the substrate may be cleaned by any suitable cleaning methods to remove polishing material, substrate dust, or other materials from the substrate surface. Cleaning may include rinsing or a water bath, for example. Additional downstream processes may include decoration such as printed inks, attachment of electronic components, additional strengthening such as IOX strengthening processes, and/or other downstream processes. In some embodiments, polished substrate edges may be further strengthened by an acid etching treatment.

It is to be appreciated that, in some embodiments, the process 500 described above may operate to simultaneously form and finish an edge surface of a substrate without mechanical grinding. That is, edge chamfering or other edge shaping may be provided by chemical and/or mechanical interaction between the polishing material and the substrate material as the polishing material is brushed over the edge surface. The process described above may operate to form and shape an edge surface without inflicting the damage that mechanical grinding, such as from grinding wheels, often produces. It is further to be appreciated that, without scratches, chips, and/or other flaws inflicted by mechanical grinding, a relatively high edge strength may be achieved using the process described above.

Figure 8:
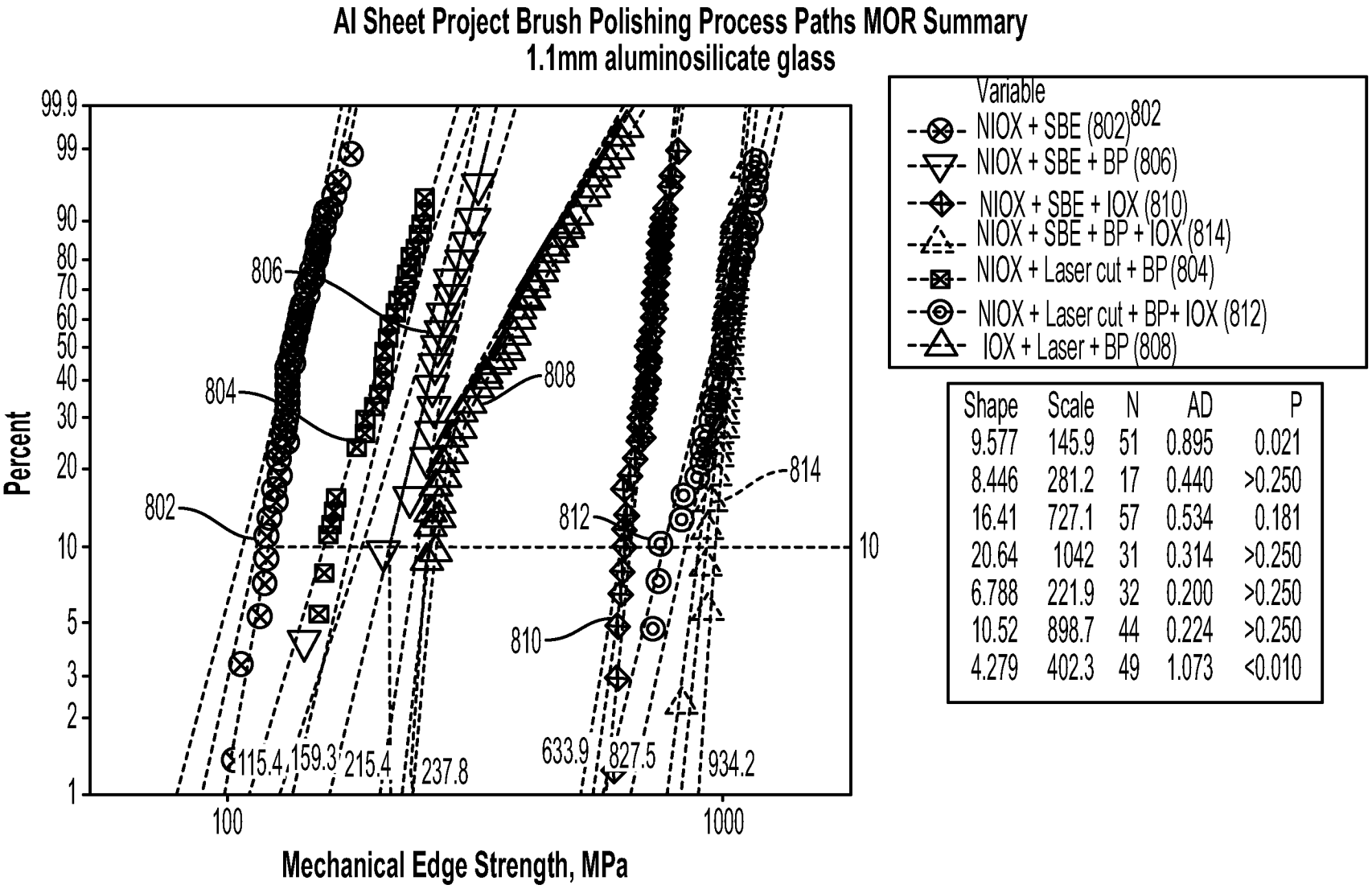
FIG. 8 is a Weibull Plot of mechanical edge strength for a plurality of forming and finishing operations.

The process 500 described above may provide for a finished substrate with a relatively high edge strength. In particular, a substrate having edges shaped and polished using the processes and apparatuses described herein may have a mechanical edge strength of at least 100 MPa, at least 300 MPa, at least 500 MPa, at least 700 MPa, at least 900 MPa, at least 1 GPa, at least 1.25 GPa, or more. FIG. 8 shows a Weibull plot of B10 mechanical edge strength of substrates manufactured using a variety of processes. A first curve 802 demonstrates edge strength of a non-chemically strengthened glass substrate ("NIOX") near-net shaped using a score and break ("SBE") process, formed and finished using conventional mechanical edge grinding with a grinder, and which is not subject to additional chemical strengthening. As shown, edge strength for the conventional process represented by curve 802 may be just over 100 MPa at B10. Curve 810 shows edge strength of a substrate manufactured by score and break and mechanical edge grinding, like the process of curve 802, but wherein the edges are additionally chemically strengthened by an ion exchange process. As shown, the ion exchange process may increase the edge strength of the substrate to approximately 630 MPa at B10. Thus is may be appreciated that the chemical strengthening provides an improvement over the process of curve 802, but due to mechanical edge grinding, the strength may still fall below 650 MPa.

With continued reference to FIG. 8, curves 804, 806, and 808 demonstrate edge strength of substrates manufactured by a variety of process paths that include simultaneous edge shaping using processes described herein. Like the conventional process represented by curve 802, the processes of curves 804, 806 and 808 do not include post-shaping chemical strengthening. In particular, curve 804 represents a non-chemically strengthened substrate near-net shaped using a laser cutting method, and simultaneously shaped and polished by the brush polishing methods ("BP") described herein. Curve 806 represents a non-chemically strengthened substrate near-net shaped using a score and break process (SBE), subject to mechanical edge grinding, and simultaneously shaped and polished by the brush polishing methods described herein. Curve 808 represents a substrate initially chemically strengthened, near-net shaped by laser cutting, and simultaneously shaped and polished by the brush polishing methods described herein. As shown, compared to the substrate formed and polished with conventional processes at curve 802, the substrate edge strength using shaping and polishing processes described herein may be at least approximately 150 MPa, at least approximately 200 MPa, or at least approximately 240 MPa, at B10 even without post-shaping chemical strengthening. It may thus be appreciated that the simultaneous edge shaping and polishing processes described herein, as compared with conventional edge forming and finishing processes, may provide for a dramatically improved edge strength.

With continued reference to FIG. 8, curves 812 and 814 demonstrate edge strength of additional substrates manufactured by process paths that include simultaneous edge shaping using processes described herein. Like the conventional process represented by curve 810, the processes of curves 812 and 814 include post-shaping chemical strengthening. In particular, curve 812 represents a non-chemically strengthened substrate near-net shaped using laser cutting, simultaneously shaped and polished using a brushing process described herein, and subject to additional chemical edge strengthening. Curve 814 represents a non-chemically strengthened substrate near-net shaped using a score and break process, subject to mechanical edge grinding, simultaneously shaped and polished using a brushing process described herein, and subject to additional chemical edge strengthening. As shown, compared to the substrate formed with conventional edge shaping and polishing at curve 810, the substrate edge strength using shaping and polishing processes described herein may be at least approximately 825 MPa or at least approximately 930 MPa at B10.

Additionally, processes of the present disclosure may produce a substrate having a relatively low edge roughness. For example, the process 500 may produce a substrate having an edge with an of between approximately 1 nm and approximately 10 nm. In some average roughness (Ra) embodiments, the Ra may be between approximately 6 nm and approximately 8 nm. Moreover, brushing processes described herein may produce a substrate edge with a root mean square roughness (rms) of between approximately 2 nm and approximately 20 nm. In some particular embodiments, the edge may have a rms of between approximately 2 nm and approximately 12 nm, or between approximately 10 nm and approximately 12 nm. In some embodiments, brushing processes described herein may produce a substrate edge with a peak to valley (PV) measurement of between approximately 50 nm and approximately 500 nm, or between approximately 80 nm and approximately 300 nm. In still other embodiments, brushing processes of the present disclosure may produce a substrate edge having a different Ra, rms, and/or PV.

Figure 9A:
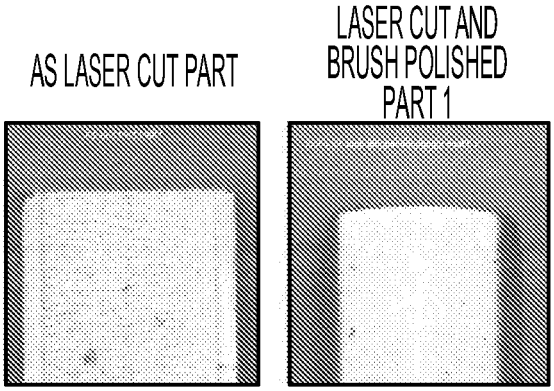
FIG. 9A is a photo showing a laminated glass substrate before and after a brushing process of the present disclosure, and shows a distribution of substrate length before and after brushing.
Figure 9A:
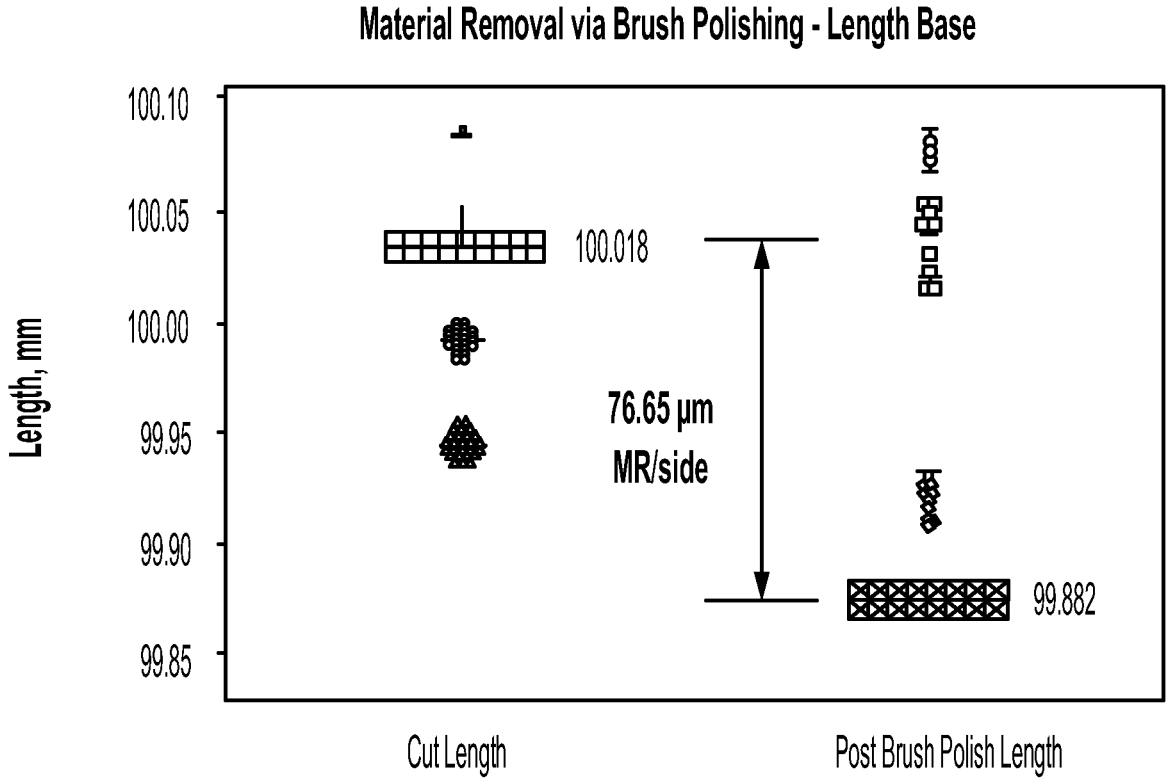
Figure 9B:
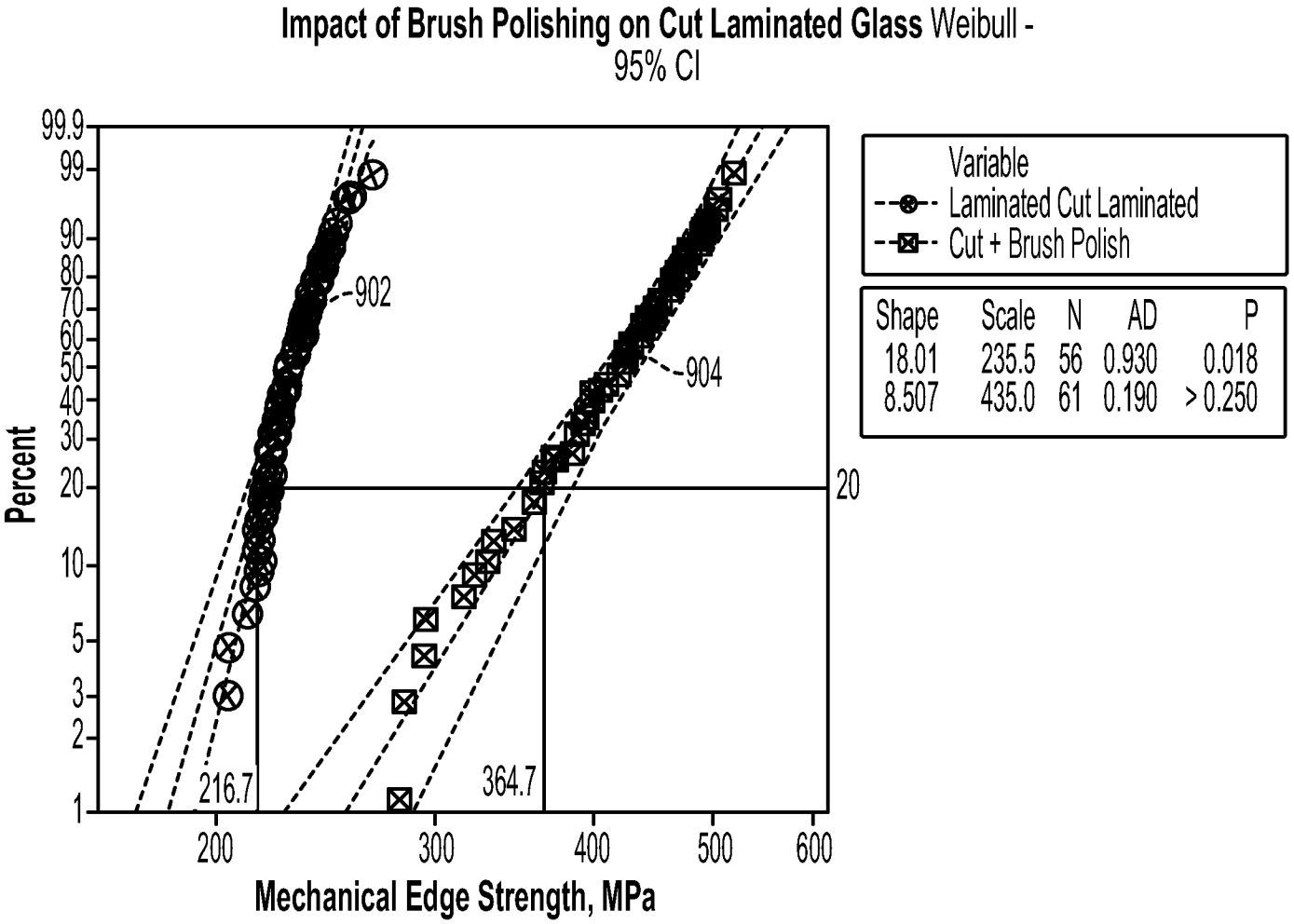
FIG. 9B is a Weibull Plot of mechanical edge strength for a laminated glass substrate before and after a brushing process of the present disclosure.

Simultaneous edge shaping and polishing processes of the present disclosure may be used to form and finish chemically strengthened substrates as well as multi-layered substrates, such as glass laminates or other laminates. It is to be appreciated that processes of the present disclosure thus may provide an improvement over conventional forming and finishing processes, as conventional mechanical grinding processes may be unsuitable for laminates and chemically strengthened materials. For example, conventional mechanical edge grinding may be unsuitable for glass laminates and other laminates because different grinding materials and/or grinders may be needed to grind core materials and clad materials of the laminated substrate. FIG. 9B shows resulting edge strength and substrate length after forming and finishing a glass laminate substrate using simultaneous brushing described herein. In particular, FIG. 9B includes a Weibull plot showing edge strength of a laminated substrate after near-net shaping at curve 902 and after simultaneous edge shaping and polishing using a process of the present disclosure at curve 904. As shown, edge forming and finishing processes of the present disclosure may increase edge strength of the laminated substrate from approximately 216 MPa to approximately 365 MPa. As additionally shown in FIG. 9A, length of the near-net shaped laminated substrate was measured at approximately 100.018 mm, while length after forming and finishing was measured at approximately 99.882 mm, resulting in removal of approximately 76.65 micrometers of material from each of two opposing sides. It may thus be appreciated that simultaneous shaping and brushing processes of the present disclosure may achieve desired edge profile shape, edge smoothness, and edge strength without excess material removal or waste. Processes of the present disclosure may additionally be employed for forming and/or finishing other laminate materials, such as relatively thin steel laminates.

A substrate formed and/or finished by a process of the present disclosure may have any desired edge profile shape. To achieve a desired edge profile shape, interposers may be sized (length, width, and thickness) and/or shaped (e.g., chamfered) to expose a desired portion or area of the substrate to the brush filaments. Additionally, in some embodiments, a brush and/or brush filaments may be sized, shaped, and/or positioned to achieve a desired substrate edge profile. For example, brush filaments may be sized, shaped, and/or arranged to define a reverse geometry of a desired edge profile shape. For example, brush filaments with varying lengths may be arranged along a brush core in rows to achieve a reverse profile shape of a desired edge profile.

For example, in some embodiments, a substrate of the present disclosure may be formed and/or finished to have a flat or squared edge profile shape. For example, and as described above with respect to FIG. 7A, a finished substrate may have an edge surface 710A extending perpendicularly between two side surfaces 712A, 714A. The edge surface 710A may extend from each side surface 712A, 714A at an angle of 90 degrees or approximately 90 degrees. In some embodiments, the substrate may have a straight or squared edge profile shape with radiused corners. That is, looking for example at FIG. 7A, a radiused corner may be provided between the perpendicular edge surface 710A and each side surface 712A, 714A.

In some embodiments, a substrate may be provided with a symmetrically chamfered (or double chamfered) edge profile shape. With reference for example to FIG. 7B, a substrate having two side surfaces 712B, 714B and a perpendicular edge surface 710B may be finished to have an angled chamfer surface extending between the edge surface and each side surface. Each chamfer surface may extend from the edge surface 710B and a side surface (712B or 714B) at an angle of 45 degrees or approximately 45 degrees. In other embodiments, the chamfer surface may have any other suitable angle.

In some embodiments, a substrate may be provided with a bullnose or other rounded or radiused edge profile shape. With reference for example to FIG. 7E, a substrate having two side surfaces 712E, 714E may be finished to have a curved edge surface 710E extending between the two side surfaces. In some embodiments, the curved edge 710E may have a radius of curvature defined to be, or to be approximately, half a thickness of the substrate. In other embodiments, the curved edge surface 710E may be provided with a different radius of curvature.

In some embodiments, a substrate of the present disclosure may have an asymmetrical edge profile shape. For example, a substrate may be finished to have a chamfered, beveled, or mitered edge profile shape. With reference for example to FIG. 7D, a substrate having two side surfaces 712D, 714D may be finished to have a tapered or angled edge surface 710D extending between the two side surfaces. The angled or tapered edge surface 710D may be arranged between the two side surfaces 712D, 714D at an angle of, or of approximately, 45 degrees in some embodiments. In other embodiments, the angled or tapered edge surface 710D may have any other suitable angle. Where the angled or tapered edge surface 710D meets each of the two side surfaces 712D, 714D, the edge profile may have a radiused corner in some embodiments.

It is to be appreciated that different edge profile shapes may be configured or suitable for different applications. In addition to those discussed above, in still other embodiments, a substrate of the present disclosure may be finished to have a double beveled, half-bullnose demi-bullnose, or ogee edge profile shape. In some embodiments, a substrate edge profile shape may be configured to have a combination of two or more of the shape elements described above. For example, in at least one embodiment, a substrate edge may be configured to have half-radiused or half-bullnose profile shape in combination with a chamfered or beveled corner surface. In particular, a substrate of the present disclosure may have a profile that extends from a first side surface of the substrate with a curved or radiused edge and extends from an opposing second side surface of the substrate with a chamfered or beveled edge having an angle of approximately 45 degrees, for example. Other asymmetrical or symmetrical edge profile shapes are contemplated as well and may be achieved by the processes described herein.

Figure 11:
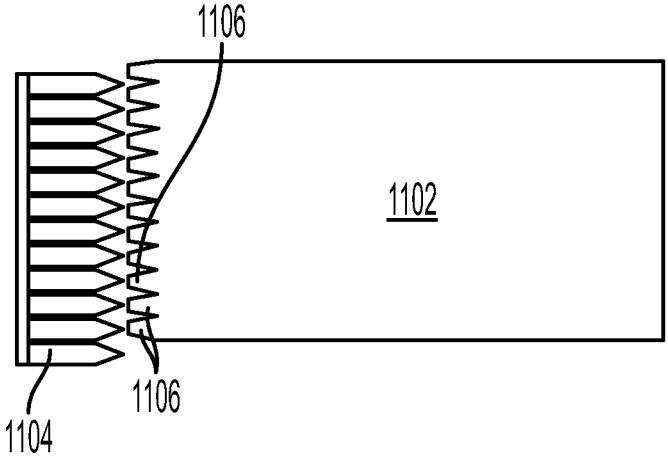
FIG. 11 is a cross-sectional diagram of a brushing operation of the present disclosure, according to one or more embodiments.

In some embodiments, a substrate of the present disclosure may be finished with a relatively complex edge profile shape. FIG. 11 shows an embodiment of a substrate 1102 having an intricate edge profile with a plurality of protrusions 1106 extending laterally from an edge of the substrate. The substrate edge may have a valley extending into the substrate between each pair of protrusions 1106. The protrusions 1106 may extend parallel with one another. The protrusions 1106 may each extend to a squared edge surface or may extend to a pointed or rounded surface in other embodiments. In some embodiments, the protrusions 1106 (and the corresponding valleys therebetween) may have angled or tapered sidewalls, as shown for example in FIG. 11. In other embodiments, protrusions 1106 (and/or the corresponding valleys therebetween) may have radiused sidewalls or may have sidewalls extending perpendicularly to an edge surface of the substrate. In at least one embodiment, a substrate edge may have one or more asymmetrical protrusions and/or one or more asymmetrical valleys. A substrate edge of the present disclosure may have any suitable number of protrusions 1106 and/or valleys, such as between 2 and 24 protrusions or valleys, or between 6 and 18 protrusions or valleys. In some embodiments, the substrate 1102 may have 12 protrusions 1106, for example. Such edge profiles may be desired for incident light collimation in light guides, for example.

With continued reference to FIG. 11, the substrate 1102, which may be near-net shaped or otherwise initially formed with a square or substantially square edge profile shape, may be arranged between a pair of interposers. A brush 1104 may be engineered with varied filament lengths arranged on a brush core to form a reverse geometry of the desired substrate edge protrusions 1106. The brush 1104 and a polishing slurry may be brought into contact with the substrate 1102. Brushing may be performed by rotating the brush 1104 against the substrate edge, and/or by rotating the substrate stack, while maintaining alignment between the reverse geometry of the brush and the substrate edge. In this way, it is to be appreciated that a z-axis of the brush, extending along a longitudinal axis of the brush, and a parallel z-axis of the substrate stack, may be maintained in fixed alignment. The reverse geometry of the filaments, maintained against the substrate edge during brushing, may operate to form the protrusions 1106 in the edge of the substrate by carving the valleys between the protrusions. Thus, the brushing step may operate to simultaneously form the desired protrusions into the edge of the substrate while also polishing the substrate edge to achieve a desired mechanical edge strength, edge roughness, and/or flaw size. It is to be appreciated that filaments of a brush may be sized, shaped, and arranged to form any desirable reverse geometry shape to form other relatively intricate or complex substrate edge profiles.

Figure 10A:
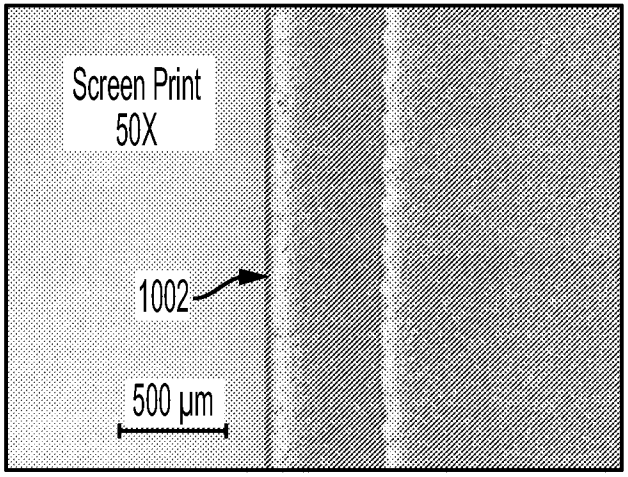
FIG. 10A is a close-up photo of an as-printed ink line on a substrate surface.
Figure 10B:
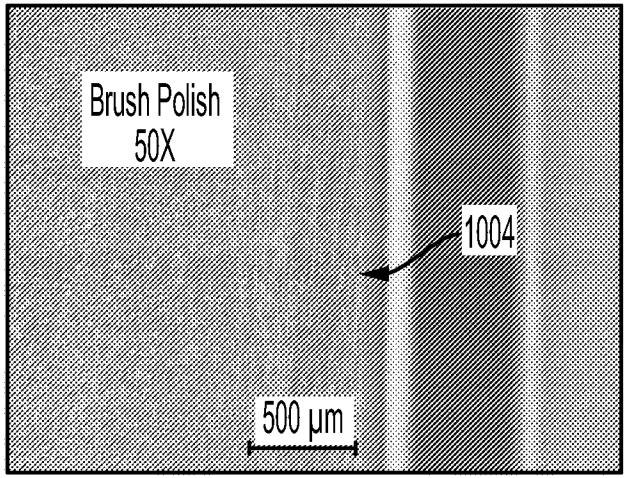
FIG. 10B is a close-up photo of an ink line on a substrate surface after being subject to a brushing operation of the present disclosure.

Additionally, processes of the present disclosure may be used to shape and/or polish decorated substrates. For example, substrates having an ink, film, device layer, which may include electrically active devices, and/or other decoration may be formed and finished using processes of the present disclosure. In at least one embodiment, a substrate of the present disclosure may have an electronic device layer printed or otherwise affixed to or arranged on a surface of the substrate. The device layer may include, for example, microLED materials having metallized (e.g., Cu) interconnects in some embodiments. In other embodiments, the device layer may have other suitable electronic components. As another example, a substrate of the present disclosure may have an ink layer printed or otherwise affixed to or arranged on a surface of the substrate. The ink layer may include organic and/or inorganic inks. Other decorative layers may include, films, or overlays are contemplated as well. Such device layers, ink layers, and/or other layers may be arranged on the substrate prior to application of a brushing process described herein. Conventional mechanical edge grinding processes may be unsuitable for such decorated substrates as the grinding may cause damage to the decoration layer. In some embodiments, processes of the present disclosure may provide for improved printing or coating processes. For example, a brushing process of the present disclosure may be used to finish a printed ink line or other decoration line. Because brushing processes of the present disclosure may be performed after decorations are applied without harming the decorations, the brushing may be used to achieve desired printing tolerances and print lines. For example, FIG. 10A shows one example of an as-screen printed ink line 1002 on a substrate edge. As may be appreciated, the ink line 1002 may be relatively uneven or jagged in some cases. Moreover, in many conventional processes, printing is performed after forming and finishing operations, thus requiring print tolerances to be carefully monitored. Using brushing processes of the present disclosure, an ink or other decoration may be printed onto the substrate prior to brushing and the brushing step may be used to achieve final print tolerances while forming and finishing the substrate edge. FIG. 10B shows an example of an ink line 1004 on a substrate edge after a brushing process of the present disclosure. As may be appreciated, the ink line 1004 may be a crisp ink line.

In some embodiments, interposers of the present disclosure may be used to apply, or assist in applying, decorations to substrates. For example, an interposer of the present disclosure may have an electronic device layer, or other desired decoration or layer, affixed thereto with a reverse configuration. The device layer or other decoration or layer may be configured to be transferrable, such that the decoration or layer may transfer from the interposer onto a substrate when the substrate is arranged in contact with the interposer. In some embodiments, the compressive force applied to a stack of substrates and interposers may help to transfer the decoration or layer from the interposer onto the substrate. In some embodiments, an adhesive layer may be applied between the decoration and substrate.

Simultaneous edge shaping and polishing processes of the present disclosure may additionally provide for a substantial time savings over conventional forming and finishing processes. That is, rather than a series of mechanical grinding steps to remove edge material and a series of polishing steps to remove flaws inflicted from the grinding, the single-stage brushing step described above may provide for a less time-consuming and less labor-intensive process.

It is to be appreciated that the processes described herein may provide for replacement of conventional mechanical near net shaping and edge finishing with a single step, semi-batch brush polishing process that simultaneously forms and finishes thin glass edges. The above solutions represent a larger opportunity to deploy a superior finishing process technology across numerous projects. This may be particularly seen with respect to automotive interior products. For example, finished thin glass product edge quality specifications for automotive interior products may be particularly demanding, requiring an edge strength of up to 215 MPa prior to chemical strengthening. Such a mechanical edge strength has been calculated to require maximum flaws post grinding not to exceed 11 microns, for example. A consequence of this is that manufacturing lines are now undergoing installation and commissioning that are not capable of meeting commercial and/or cost model objectives for edge finished thin glass products. Additionally, some manufacturers and industries have shown an increasing demand for thin glass parts that can be cold formed; such capability requires relatively high edge strength, which may be higher than can be achieved by conventional mechanical edge grinding followed by chemical strengthening.

While the edge forming and finishing processes described herein may be used in place of conventional grinding steps, it may further be appreciated that brushing processes described herein may be used in combination with substrate edge grinding in some embodiments. For example, a near-net shaped substrate may have edges formed by one or more mechanical grinding steps, after which the substrate may be arranged between interposers and subject to a brushing process described herein to polish edges to achieve a desire edge strength. Mechanical grinding may be performed using an abrasive grinding medium having a suitable abrasive size. Additionally, edge forming and finishing processes described herein may be used in place of, or in combination with, chemical edge strengthening processes such as, but not limited to, HF treatment and ion exchange treatment.

Forming and finishing processes of the present disclosure may provide for an ability to meet or exceed relatively high edge strength requirements by forming and finishing with brushing and polishing material and, in some embodiments, without employing mechanical edge grinding. Conventional mechanical edge grinding processes may not be capable of achieving the thin substrate edge strength that can be achieved using brushing processes of the present disclosure. As described above, edge strength of substrates prior to final chemical strengthening may reach up to 150, 200, 250, 300 or more MPa using brushing processes of the present disclosure. Moreover, with the addition of a final chemical strengthening step, edge strength of a finished product may reach up to 500, 700, 800, 900, or 1000 MPa in some embodiments. Forming and finishing processes of the present disclosure may provide for up to, or more than, a 30% edge strength increase over conventional processing paths, which may in turn enable cold forming applications for thin glass products. Additionally, the polished edge surfaces and low flaws of the substrates may allow for automated inspection of sampled parts.

Forming and finishing processes of the present disclosure may additionally provide for more efficient and cost-effective manufacturing. In particular, a plurality of substrates, including tens or even hundreds of substrates, may be arranged in a stack with an interposer arranged between each substrate. The stack of substrates may be formed and finished together using the brushing processes described herein. Thus, processing time may be reduced to less than 10 minutes, less than 5 minutes, or less than 3 minutes per part. Additionally, processes of the present disclosure may have lower material waste as compared with conventional forming and finishing processes. In particular, brush polishing may achieve a desired edge shape and polish with less material removal than may be needed with a conventional grinding process. Moreover, processes of the present disclosure may provide for improved processing efficiency by allowing for edge forming and finishing to be performed on substrates after application of inks, devices, films, and/or other decorations. By applying decorations prior to edge forming and finishing, process time may be reduced dramatically. Forming and finishing processes of the present disclosure may also be versatile in that such processes may be applied to a relatively wide variety of substrate materials, including for example, laminate materials and chemically strengthened materials, both of which may present challenges for conventional forming and finishing processes.

Figure 12:
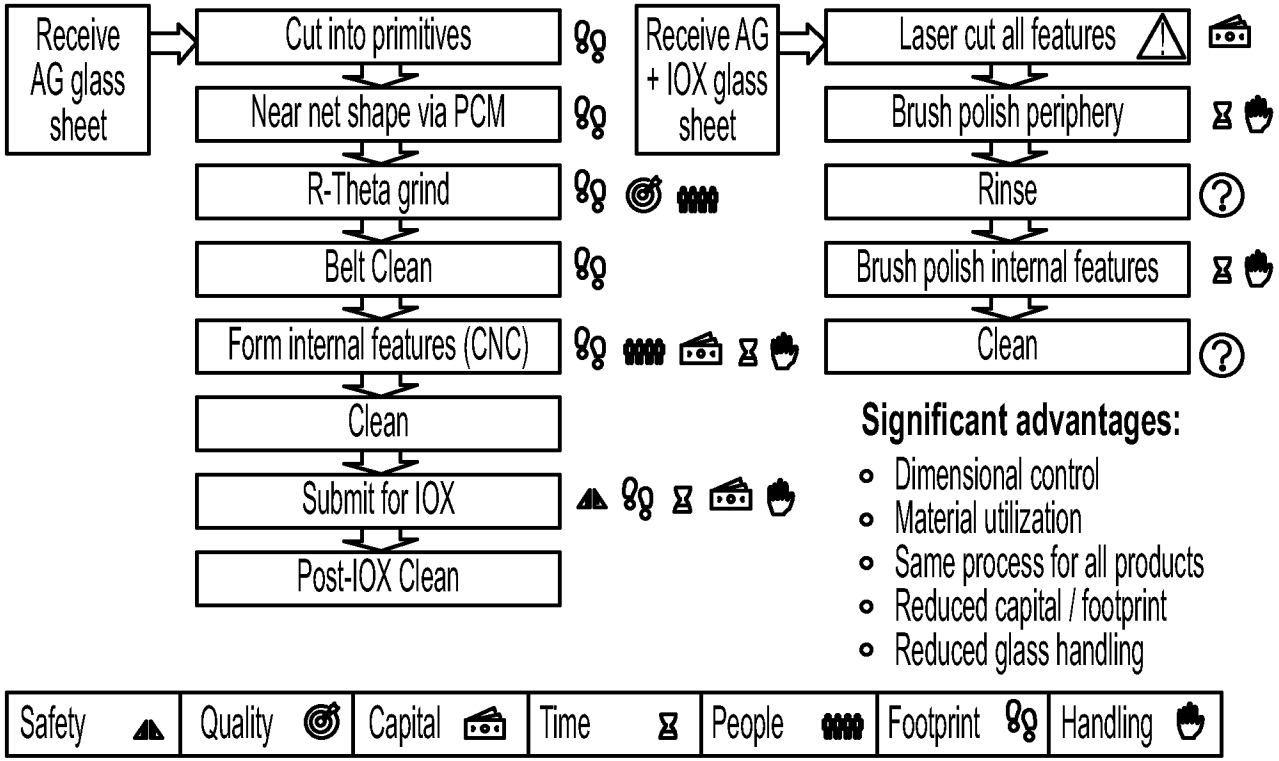
FIG. 12 is a flow diagram of a forming and finishing process of the present disclosure compared with a conventional forming and finishing process.

FIG. 12 illustrates a substrate manufacturing process of the present disclosure 1202, according to at least some embodiments, as compared with a conventional substrate manufacturing process 1204. As may be appreciated from FIG. 12, forming and finishing processes of the present disclosure may allow for glass or other substrates to be chemically strengthened prior to forming and finishing operations, which may reduce time and expense in the manufacturing process. Additionally, by eliminating mechanical edge grinding, time, expense, and worker time may be reduced as well.

Following are some additional advantages that may be achieved by edge forming and finishing processes of the present disclosure:

1. Efficiency of chemical strengthening processing may be accomplished by processing glass in the form of full sheets instead of as individually finished thin glass parts.
2. Singulation and edge finishing of chemically strengthened and/or laminated glasses via nano-perforation laser cutting, or other laser cutting, may be accomplished more cheaply and at greater volume through elimination of a thermal separation step typically used when last cutting non-chemically strengthened substrates.
3. Dimensional error attributable to near net shaping, edge finishing, and ion exchange processing may be substantially decreased, thereby establishing tight dimensional control of finished parts critical for downstream decoration operations (e.g., screen printing).
4. Laser cutting technology may be leveraged for near-net shaping. In particular, material utilization gains associated with precise laser cutting may be realized, dimensional precision enabling minimal material removal may be realized, low depth of damage enabling minimal material removal may be realized, ready application to chemically strengthened substrates, and ready application to fusion drawn glass laminates and other laminates.
5. Relatively expensive edge finishing platforms (e.g., cutting platforms, conveyance, grinding platforms) may be replaced with smaller footprint laser cutting tools and substantially cheaper brush polishing tools. For example, consumable sets associated with conventional grinding (e.g., grind wheels, dressing materials, cutting wheels) may be replaced with relatively inexpensive brushes and interposers.
6. Engineering of brushes, engineering of interposers, and/or strategic part stacking may be engineered to impose asymmetric edges on substrates.
7. Because processes described herein allow for forming and finishing decorated substrates, parts may be decorated more efficiently on full sheets prior to forming and finishing operations. Additionally, substrates may be overcoated and the finished ink line may be formed and defined using the brushing operations described herein.
8. In some embodiments, processes of the present disclosure may result in a mechanical edge strength of up to, or more than, 1 GPa, which may be particularly suitable for cold forming applications.
9. Forming and finishing processes of the present disclosure may be tailored to suit a variety of different substrate materials, including but not limited to ceramics, glasses, silicon, and metals.
10. Processes of the present disclosure may provide for relatively inexpensive and simple post-polishing cleaning, which may include a relatively inexpensive rinse step and/or sonicated cleaning bath.
11. Processes described herein may eliminate or reduce a need for visual inspection conducted by specially trained inspectors.

Figure 13A:
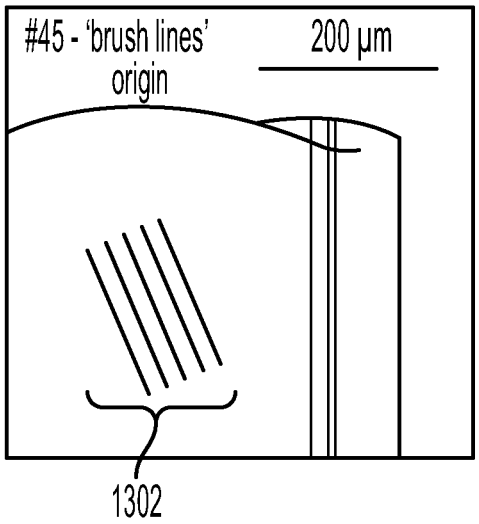
FIG. 13A is a photomicrograph of a formed and finished substrate edge of the present disclosure, according to one or more embodiments.
Figure 13B:
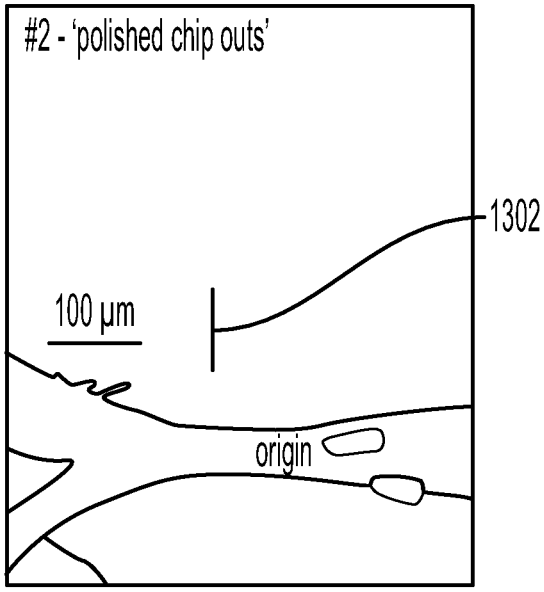
FIG. 13B is another photomicrograph of a formed and finished substrate edge of the present disclosure, according to one or more embodiments.
Figure 13C:
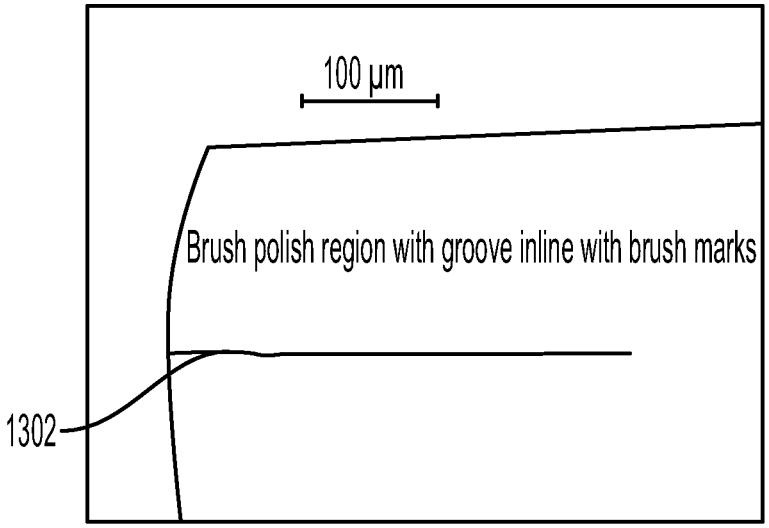
FIG. 13C is another photomicrograph of a formed and finished substrate edge of the present disclosure, according to one or more embodiments.

In some embodiments, a substrate produced or processed by brushing processes described herein may have an optical quality edge with fine brush marks visible via magnification on the substrate edge, bevel, and/or side surface adjacent to the edge. Additionally, the substrate may have an optical quality border region on a side surface adjacent the edge. The substrate may have optically visible vertical nanoperforation edge striations obscured by an optical quality edge finish. Additionally, where a substrate with a printed decoration is subject to a brushing process of the present disclosure, an ink line of the decoration may be crisp with a sharp definition and may be free of a jagged or waved shape. Visible brush marks resulting from a brushing process of the present disclosure may be seen, according to one embodiment, in the photomicrographic images of FIGS. 13A, 13B, and 13C. As shown in FIG. 13A, brush lines 1302 may be imparted an edge of the finished substrate, the brush lines may be parallel or substantially parallel to a line of motion where filaments contacted the substrate edge surface. The brush lines or marks may be arranged parallel or substantially parallel to one another, and parallel or substantially parallel to a line longitudinally arranged along the substrate edge. In some embodiments, brush lines or marks may have a length of approximately half of the thickness of the substrate. In some embodiments, the brush lines or marks may have a depth of less than 2 μm, less than 1.5 μm, or less than 1 μm.

A number of embodiments are described in the following paragraphs to provide some examples of manufacturing processes of the present disclosure. It is to be appreciated that the following embodiments are provided as examples, and the application is not limited to the following embodiments.

In at least one embodiment of the present disclosure, non-strengthened thin glass substrates or other non-strengthened substrates may be prepared by a range of near net shaping technologies including, but not limited to: conventional picosecond laser cutting (nanoperforation and subsequent thermal separation); crack propagation control (CPC) picosecond laser cutting (nanoperforation and subsequent thermal separation); picosecond partial laser cutting (partial nanoperforation) and subsequent mechanical separation; ablative laser cutting (CO2, fiber laser) and subsequent mechanical separation; mechanically scoring, breaking, and edge grinding, and/or mechanically scoring and breaking. The non-strengthened thin glass substrates or other non-strengthened substrates may have edges simultaneously formed to a desired edge profile and polished to a high-quality edge finish with characteristically low residual damage and flaw distribution and therefore high mechanical edge strength. A stack composed of alternating thin substrates and engineered interposers may be produced. The interposers may be strategically positioned to control exposure of the edge to be polished to the polishing medium(s) and slurry(ies). The interposers employed may be designed with a combination of desired mechanical (relative dimensions, edge profile, compressibility, slip-stick coefficient, coefficient of thermal expansion, abrasion resistance, static charge), chemical (polishing slurry resistance, alkalinity resistance), electrical (static charge), and magnetic material properties. The stack may be restrained via simple prolonged mechanical compression. The thin substrate edges with controlled edge exposure may be subjected to a brush polishing process in which brushes are brought into controlled contact with the engineered stack of thin substrates and contacted with continuous streams of polishing slurry in a programmed set of operating motions. Brushes may be cylindrical brushes composed of engineered filaments of small (≤0.200 mm) diameter and a range of lengths fastened together in bundles or "tufts" of a range of sizes (e.g., 3-5 mm), patterns (e.g., spiral, staggered, straight), and brush densities, and may be rotated at prescribed linear or surface speeds (10-1000 rpm). The substrates may be brush polished until residual subsurface damage from near net shaping is reduced to characteristic maximum flaw size <2 microns and the desired edge profile is imposed. The substrates may be further polished via subsequent brush polish step(s) with engineered finer polishing slurries employing separate brushes thereby further reducing residual subsurface damage. Thin glass substrates or other substrates processed via this process may be subsequently strengthened after forming and finishing by to further increase mechanical strength. Thin glass substrates or other substrates that are of ion exchangeable composition may be chemically strengthened to incrementally increase mechanical edge strength after forming and finishing.

In at least one embodiment of the present disclosure, strengthened or laminated thin glass articles or other substrates may be prepared by a range of near net shaping technologies, including but not limited to, those listed above. The strengthened or laminated thin glass substrates or other substrates may have edges simultaneously formed to a desired edge profile and polished to a high-quality edge finish with characteristically low residual damage and flaw distribution and therefore high mechanical edge strength by the processes described herein.

In at least one embodiment of the present disclosure, strengthened and decorated thin glass substrates or other substrates prepared by decoration via screen printing of multiple parts on a full sheet with fiducials applied to enable crack propagation control (CPC) picosecond laser cutting (nanoperforation followed by self-separation) may have edges simultaneously formed to a desired edge profile and polished to a high-quality edge finish with characteristically low residual damage and flaw distribution and therefore high mechanical edge strength by the processes described herein.

In at least one embodiment of the present disclosure, strengthened and subsequently over-decorated thin glass substrate or other substrates prepared by decoration via screen printing of multiple parts on a full sheet with fiducials applied to enable crack propagation control (CPC) picosecond laser cutting (nanoperforation followed by self-separation) may have edges simultaneously formed to a desired edge profile and polished to a high-quality edge finish with characteristically low residual damage and flaw distribution and therefore high mechanical edge strength by processes described herein. Strategic interposers may be positioned between the substrates in such a way as to simultaneously allow removal by polishing a section of surface over-decoration thereby forming the decoration boundary instead of just preserving an existing one.

In at least one embodiment of the present disclosure, edges of internal features of thin glass substrates or other substrates may be simultaneously formed and finished. Internal features may be machined (mechanically formed or laser ablated/laser cut) into thin glass parts, such as non-strengthened glass, strengthened glass, laminated glass, strengthened and decorated glass substrates, or other substrates. Internal features may include holes, slots, and/or irregular features such as keyholes and other regular or irregular shapes. Interposers may be configured to have corresponding internal features. A stack may be produced composed of alternating substrates and engineered interposers such that internal features are aligned to allow access to internal edges. The interposers may be strategically positioned to control exposure of the internal edges to be polished to the polishing medium(s) and slurry(ies). The interposers may be designed with a combination of desirable mechanical (relative dimensions, edge profile, compressibility, slip-stick coefficient, coefficient of thermal expansion, abrasion resistance, static charge), chemical (polishing slurry resistance, alkalinity resistance), electrical (static charge), and magnetic material properties. The stack may be restrained via simple prolonged mechanical compression. The thin glass edges with controlled edge exposure may be subjected to a brush polishing process in which one or more brushes are brought into controlled contact with the stack allowing passage of reduced diameter brushes through the internal feature openings with a honing motion. Brushes may be cylindrical brushes composed of engineered filaments of small (≤0.200 mm) diameter and a range of lengths fastened together in bundles or "tufts" of a range of sizes (e.g., 3-5 mm), patterns (e.g., spiral, staggered, or straight), and brush densities may be rotated at prescribed speeds (100-1000 rpm) and contacted with continuous streams of polishing slurry in a programmed set of operating motions. The substrate internal features may be polished until residual subsurface damage from near net shaping is reduced to characteristic maximum flaw size <2 microns and the desired edge profile is imposed. The internal feature edges may be further polished via subsequent brush polish step(s) with engineered finer polishing slurries employing separate brushes thereby further reducing residual subsurface damage. The internal features may be chemically strengthened by exposure to HF to incrementally increase mechanical edge strength after brushing.

In at least one embodiment, glass or aluminum discs intended for use in data storage (e.g., hard drive storage discs) may be molded or fusion formed and then laser near net shaped. The discs may have a perimeter edge and may additionally have an internal feature edge surrounding a central hole. Edges of both the perimeter and internal center hole may be brush polished according to processes of the present disclosure until both perimeter and internal center hole edges are formed and finished to the desired shape, strength, smoothness, and/or degrees of flaws or damage.

In at least one embodiment of the present disclosure, intricate edge features, such as those used in collimation of incident light in light guides may be formed and finished using a brushing process of the present disclosure. For example, thin glass light guides bearing collimation features, such as those shown in FIG. 11 may be interleaved with engineered interposers to form a part stack. The interposers may be designed such that the collimation features are not supported; that is, the interposers may have a length and width so as to stop short of the collimation features (this may allow polishing slurry to be channeled by gravity feed into the hardest areas to reach for polishing). Additionally, the interposers may be configured to be relatively thin, with a thickness of between approximately 0.1-0.5 times a thickness of the substrates to be finished. The interposers may have a length and width only slightly smaller than that of the substrates, so as to allow for shaping of a generally flat edge profile. A brush having filament bundles formed or shaped into a reverse geometry of the collimation feature to be polished may be arranged on the circumference of a cylindrical core in straight rows such that they line up with the collimation features on the light guide parts. The brush may be brought into contact with the occluded collimation feature edges and these edges polished, including the collimation feature wells.

Where a substrate, such as a thin glass light guide, has a device layer imprinted or deposited on a side surface, which may be relatively fragile or sensitive, interposer materials may be selected to protect the device layer. For example, a suitable interposer may be configured with one or more soft, compressible materials or material layers. The interposer may have one or more outer liner layers. The interposer may be configured to mechanically absorb substrate surface devices to protect such devices from slurry incursion but also from compression damage. As an example, the interposer may be or include HT6135 silicone elastomer material, as manufactured by Marian Chicago, Inc., with plastic liners arranged on both sides. Additionally, when arranged in a stack for brushing, the substrates may each be oriented such that the side bearing sensitive features faces downward. A plastic liner may be removed from one side from each interposer, and the interposers may be oriented such that the soft elastomer face with plastic liner removed is pressed against the sensitive device layer of one substrate, and the other side of the interposer (with plastic liner still adhered to interposer) put in contact with the back of an adjacent substrate. The elastomer material may form a seal against the device layer of the substrate, which may be a liquid impermeable seal. In some embodiments, the interposers may remain in place during downstream post-brushing processing. The interposers may be readily peeled from the glass surfaces bearing sensitive features.

In at least one embodiment of the present disclosure, substrate edges may be formed and finished using mechanical slurry particles. A suitable mechanical slurry may be or include the DND Nanodiamond slurry product portfolio (includes DIA-SOL HL product name and brand) manufactured for and distributed by Fujimi Corporation—these slurries are produced in concentrated (50 ct/liter) form and in a wide range of particle sizes (30 nm-75 μm) and types (friable, metal bond). Other suitable mechanical slurry particles may be used additionally or alternatively. The slurry is dispensed in its most concentrated form (e.g., 50 ct/liter) for maximum efficiency, however dilution with water may be practiced as desired. The mechanical slurry particles may be readily rinsed clean after brushing.

In at least one embodiment of the present disclosure, substrate edges may be formed and finished using a colloidal silica and accelerant (commonly KOH but not limited to this) as a chemical/mechanical slurry. This may be particularly useful for forming and finishing edges of silicon substrates. Continuous streams of the colloidal silica/KOH polishing slurry may be released during brushing. The slurry may be dispensed in dilute form (e.g., 20:1 slurry in deionized water), however other dilutions may be used. The substrates may be further polished via subsequent brush polish step(s) with engineered finer chemical/mechanical polishing slurries (e.g., highly dilute, ammonia stabilized colloidal silica finishing slurries such as Fujimi Glanzox products).

In at least one embodiment of the present disclosure, brush polishing may be performed using interposers having a transferrable pattern (e.g., decal), enabling edge finishing to be conducted while the pressure used to restrain the stack is used to simultaneously transfer the pattern on the interposer onto a surface of the thin glass substrates. For example, a stack may be produced composed of alternating substrates and interposers. The interposers may be strategically positioned to control exposure of the edge to be polished to the polishing medium(s) and slurry(ies). The interposers may be designed with a combination of desired mechanical (relative dimensions, edge profile, compressibility, slip-stick coefficient, coefficient of thermal expansion, abrasion resistance, static charge), chemical (polishing slurry resistance, alkalinity resistance), electrical (static charge), and/or magnetic material properties. The interposers may additionally each have a transferrable decoration material arranged thereon and configured for activation by contact and pressure, such that during restraint by compression and brush polishing, desired decoration patterns may be transferred to the substrates being polished. The stack may be restrained via simple prolonged mechanical compression. The substrate edges may be subjected to a brush polishing process in which cylindrical brushes composed of engineered filaments of small (≤0.200 mm) diameter and a range of lengths fastened together in bundles or "tufts" of a range of sizes (e.g., 3-5 mm), patterns (e.g., spiral, staggered, straight), and/or brush densities are rotated at prescribed speeds (10-1000 rpm) and contacted with continuous streams of polishing slurry in a programmed set of operating motions. The filaments may be brought into controlled contact with the engineered stack of substrates. The substrates may be polished until residual subsurface damage from near net shaping is reduced to characteristic maximum flaw size <2 microns and the desired edge profile is imposed. The substrates may be further polished via subsequent brush polish step(s) with engineered finer polishing slurries employing separate brushes thereby further reducing residual subsurface damage. The substrates may be further chemically strengthened by exposure to HF and/or ion exchange.

In at least one embodiment, a brushing process of the present disclosure may provide for reduced polishing cycle time, as compared with conventional polishing operations. For example, a brush may be operated to have a smooth polar polishing motion along an edge of the substrate stack, without intentional dwelling of polishing pressure and/or time on substrate corners or other edge features. In this way, a brush of the present disclosure may be continuously moved along a substrate perimeter edge with a constant or near constant linear speed (e.g., between 5-100 mm/min, or another suitable speed). It is to be appreciated that without corner or other feature dwelling or rounding motions, typical of conventional brushing operations, brush polishing operations of the present disclosure may be performed with reduced pass cycle times. Such compact polar polishing passes may be repeated to achieve a relatively high resolution.

In at least one embodiment, an interposer of the present disclosure may be or include one or more magnetically active materials. Moreover, in some embodiments, endcaps or chucks arranged at each end of the part stack may be configured to provide an electrostatic force. Together, the electrostatic endcaps and magnetic interposers may operate to maintain alignment of the interposers and substrates during brush processing. In some embodiments, this may be used to maintain alignment instead of, or in addition to, a compressive force applied to the stack.

Aspect (1) of this disclosure pertains to a substrate with a polished edge, the substrate comprising: a mechanical edge strength of at least 700 MPa; and edge flaws of not more than 2 microns in size.

Aspect (2) of this disclosure pertains to the substrate of Aspect (1) wherein the polished edge comprises a plurality of brush marks arranged thereon in a substantially parallel configuration, the brush marks imparted by a brush polishing process.

Aspect (3) of this disclosure pertains to the substrate of Aspect (2), wherein the brush marks are arranged parallel to a longitudinal axis of the polished edge.

Aspect (4) of this disclosure pertains to the substrate of any one of Aspects (1) through (3), wherein the substrate comprises a thickness of between approximately 0.01 mm and approximately 6.0 mm.

Aspect (5) of this disclosure pertains to the substrate of any one of Aspects (1) through (4), wherein the substrate comprises a mechanical edge strength of at least 1 GPa.

Aspect (6) of this disclosure pertains to the substrate of any one of Aspects (1) through (5), wherein the substrate comprises a chamfered or radiused edge profile.

Aspect (7) of this disclosure pertains to the substrate of any one of Aspects (1) through (5), wherein the substrate comprises a square, bullnose, or chamfered edge profile.

Aspect (8) of this disclosure pertains to the substrate of any one of Aspects (1) through (7), wherein the substrate comprises a symmetrical edge profile.

Aspect (9) of this disclosure pertains to the substrate of any one of Aspects (1) through (7), wherein the substrate comprises an asymmetrical edge profile.

Aspect (10) of this disclosure pertains to the substrate of Aspect (8), wherein the asymmetrical edge profile comprises a chamfered surface and a radiused surface.

Aspect (11) of this disclosure pertains to the substrate of Aspect (9), wherein the edge profile comprises a chamfered surface and a radiused surface.

Aspect (12) of this disclosure pertains to the substrate of any one of Aspects (1) through (11), wherein the polished edge has a plurality of shaped protrusions extending laterally therefrom.

Aspect (13) of this disclosure pertains to the substrate of Aspect (10), wherein each protrusion has a first tapered sidewall and a second tapered sidewall.

Aspect (14) of this disclosure pertains to the substrate of any one of Aspects (1) through (13), wherein the substrate comprises an edge average roughness of between approximately 1 nm and approximately 10 nm.

Aspect (15) of this disclosure pertains to the substrate of any one of Aspects (1) through (14), wherein the substrate comprises an edge root mean square roughness of between approximately 2 nm and approximately 20 nm.

Aspect (16) of this disclosure pertains to the substrate of any one of Aspects (1) through (15), wherein the substrate comprises an edge roughness peak to valley measurement of between approximately 5 nm and approximately 500 nm.

Aspect (17) of this disclosure pertains to the substrate of any one of Aspects (1) through (16), wherein the substrate comprises strengthened glass, unstrengthened glass, a steel laminate, a ceramic substrate, or silicon substrate.

Aspect (18) of this disclosure pertains to the substrate of any one of Aspects (1) through (17), wherein the substrate comprises an electronic device layer arranged on a surface thereof.

Aspect (19) of this disclosure pertains to the substrate of any one of Aspects (1) through (18), wherein the substrate comprises an ink layer arranged on a surface thereof.

Aspect (20) of this disclosure pertains to the substrate of Aspect (19), wherein an edge of the ink layer is brush polished.

Aspect (21) of this disclosure pertains to the substrate of any one of Aspects (1) through (20), wherein the substrate is a strengthened glass comprising a chemically strengthened glass or a glass laminate.

Aspect (22) of this disclosure pertains to a method of simultaneously forming and finishing an edge surface of a substrate, the method comprising: arranging a near-net shaped substrate between a first interposer and a second interposer; applying a compressive force to the substrate and interposers; and simultaneously shaping and polishing an edge surface of the substrate using a brush; wherein each interposer device comprises a size and edge profile configured to guide the brush to achieve a desired edge profile shape of the substrate.

Aspect (23) of this disclosure pertains to the method of Aspect (22), wherein simultaneously shaping and polishing the edge surface of the substrate comprises brushing the edge surface of the substrate with a rotary brush and polishing slurry.

Aspect (24) of this disclosure pertains to the method of Aspect (23), wherein the polishing slurry comprises at least one of a cerium oxide of grain size ranging from 0.3 to 15.0 μm and a mechanical abrasive slurry with an abrasive size ranging from 30 nm to 100 μm.

Aspect (25) of this disclosure pertains to the method of any one of Aspects (22) through (24), wherein the polishing slurry comprises an alkalinity ranging from pH 6-11.

Aspect (26) of this disclosure pertains to the method of any one of Aspects (22) through (25), wherein the brush comprises a plurality of filaments, each having a diameter of not more than 0.2 mm.

Aspect (27) of this disclosure pertains to the method of any one of Aspects (22) through (26), wherein each interposer device comprises a thickness of between 0.01 and 10 times a thickness of the substrate.

Aspect (28) of this disclosure pertains to the method of any one of Aspects (22) through (27), wherein simultaneously shaping and polishing an edge surface of the substrate comprises chamfering and polishing an edge surface of the substrate.

Aspect (29) of this disclosure pertains to the method of any one of Aspects (22) through (28), wherein a liquid impermeable seal is formed between each interposer device and the substrate.

Aspect (30) of this disclosure pertains to the method of any one of Aspects (22) through (29), wherein the substrate comprises strengthened glass, unstrengthened glass, a steel laminate, a ceramic substrate, or a silicon substrate.

Aspect (31) of this disclosure pertains to the method of any one of Aspects (22) through (30), wherein the first interposer has a first size and the second interposer has a second size smaller than the first size.

Aspect (32) of this disclosure pertains to the method of any one of Aspects (22) through (31), further comprising near-net shaping the substrate using a laser edge chamfering process.

Aspect (33) of this disclosure pertains to an interposer for separating adjacent near-net shaped substrates during a brushing operation performed on an edge surface of the substrates, the interposer comprising: a perimeter shape configured to align with a perimeter shape of the substrates;

a thickness of between 0.01 and 10 times a thickness of the substrates; an edge profile corresponding to a desired edge profile of the substrates; and a width corresponding to a desired the desired edge profile of the substrates.

Aspect (34) of this disclosure pertains to the interposer of Aspect (33), further comprising a gromet arranged through an opening in the interposer, the gromet configured to increase friction between the interposer and adjacent substrates.

Aspect (35) of this disclosure pertains to the interposer of Aspect (33) or Aspect (34), wherein the interposer comprises an opening configured to align with an opening of the substrates for brushing of an interior edge of the substrates.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A substrate with a polished edge, the substrate comprising:

a mechanical edge strength of at least 700 MPa; and edge flaws of not more than 2 microns in size, wherein the polished edge comprises a plurality of brush marks arranged thereon in a substantially parallel configuration, the brush marks imparted by a brush polishing process.

2. The substrate of claim 1, wherein the brush marks are arranged parallel to a longitudinal axis of the polished edge.

3. The substrate of claim 1, wherein the substrate comprises a thickness of between approximately 0.01 mm and approximately 6.0 mm.

4. The substrate of claim 1, wherein the substrate comprises a mechanical edge strength of at least 1 GPa.

5. The substrate of claim 1, wherein the substrate comprises a chamfered, radiused, square, or bullnose edge profile.

6. The substrate of claim 1, wherein the substrate comprises a symmetrical edge profile.

7. The substrate of claim 1, wherein the substrate comprises an asymmetrical edge profile, wherein the asymmetrical edge profile comprises a chamfered surface and a radiused surface.

8. The substrate of claim 1, wherein the polished edge has a plurality of shaped protrusions extending laterally therefrom, wherein each protrusion has a first tapered sidewall and a second tapered sidewall.

9. The substrate of claim 1, wherein the substrate comprises an edge average roughness of between approximately 1 nm and approximately 10 nm.

10. The substrate of claim 1, wherein the substrate comprises an ink layer arranged on a surface thereof.

11. The substrate of claim 10, wherein an edge of the ink layer is brush polished.

* * * * *